US009359127B2

(12) United States Patent
Meelker et al.

(10) Patent No.: US 9,359,127 B2
(45) Date of Patent: Jun. 7, 2016

(54) CAPSULE, AND METHOD OF PRODUCING IT

(75) Inventors: Laurentius Gerardus Meelker, Zaandijk (NL); Erwin Bartelds, Assendelft (NL); Jozef Henricus Pollmann, Ouderkerk aan de Amstel (NL); Freerk Van Oudheusden, Voorhout (NL); Marlies Van Dullemen, Leiden (NL)

(73) Assignee: Ahold Coffee Company B.V., Zaandam (NL)

( * ) Notice: Subject to any disclaimer, the term of this patent is extended or adjusted under 35 U.S.C. 154(b) by 708 days.

(21) Appl. No.: 13/609,278

(22) Filed: Sep. 11, 2012

(65) Prior Publication Data

US 2013/0064936 A1 Mar. 14, 2013

(30) Foreign Application Priority Data

Sep. 14, 2011 (NL) ..... 2007417

(51) Int. Cl.
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/816; B65B 29/02; B65B 29/06
USPC ..... 426/77–99; 99/295
See application file for complete search history.

(56) References Cited

U.S. PATENT DOCUMENTS

| | | | | |
|---|---|---|---|---|
| 4,136,202 | A | 1/1979 | Favre | |
| 2003/0056661 | A1 | 3/2003 | Hu et al. | |
| 2006/0130664 | A1* | 6/2006 | Majer Doglioni | 99/275 |
| 2009/0175986 | A1* | 7/2009 | Doglioni Majer | 426/77 |
| 2010/0034929 | A1* | 2/2010 | Dogan et al. | 426/89 |
| 2010/0178392 | A1 | 7/2010 | Yoakim et al. | |
| 2011/0033580 | A1 | 2/2011 | Biesheuvel | |
| 2011/0212225 | A1 | 9/2011 | Mariller | |

FOREIGN PATENT DOCUMENTS

| | | |
|---|---|---|
| EP | 2210827 | 7/2010 |
| WO | 2004026091 | 4/2004 |
| WO | 2010128844 | 11/2010 |

OTHER PUBLICATIONS

Dutch Search Report, mailed Apr. 4, 2012 in connection with Dutch Patent Application No. 2007417.

European Search Report, mailed on Nov. 30, 2012 in connection with European Patent Application No. 12183793.4.

* cited by examiner

*Primary Examiner* — Erik Kashnikow
*Assistant Examiner* — Chaim Smith
(74) *Attorney, Agent, or Firm* — Steven M. Koehler; Westman, Champlin & Koehler, P.A.

(57) ABSTRACT

There is disclosed a capsule for the preparation of a beverage using an extractable and/or dissolvable product and a quantity of hot and/or pressurized liquid. The capsule comprises a circumferential wall having on one end a bottom adapted to allow entrance of the liquid, and on an opposite end a lid closing said end of the circumferential wall. The circumferential wall, bottom and lid enclosing an inner space containing the product. At least one of the lid and/or bottom comprises at least one first portion and at least one second portion separated by at least one slit and having different moving mechanics when under pressure. At least a layer of tearable material covers said slit.

19 Claims, 24 Drawing Sheets

11
8
17
10
9
16

11
8
9
16

11
8
17
10'
16
9

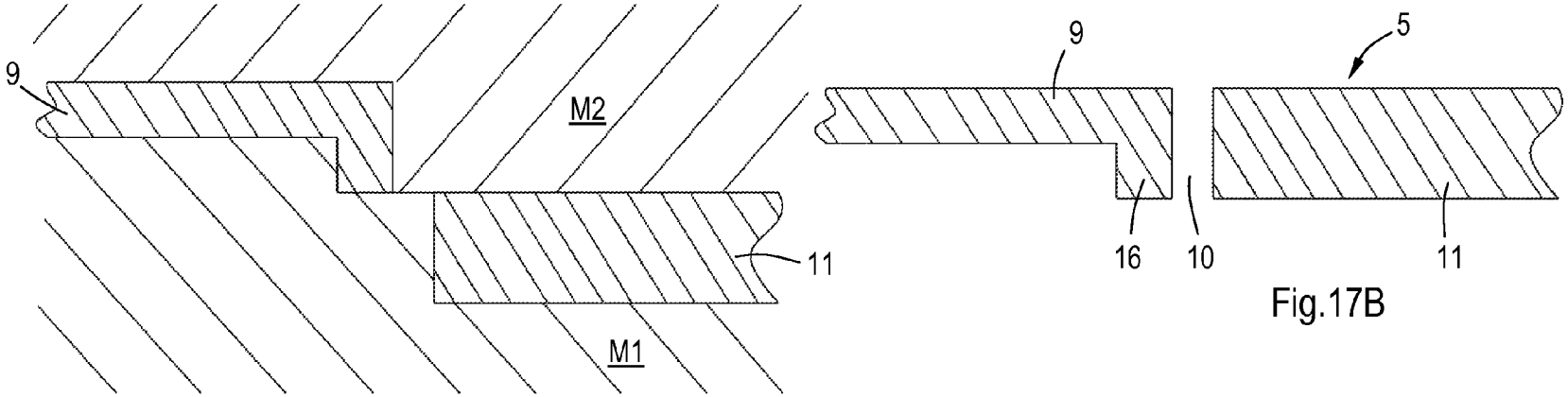
Fig.17A
Fig.17B
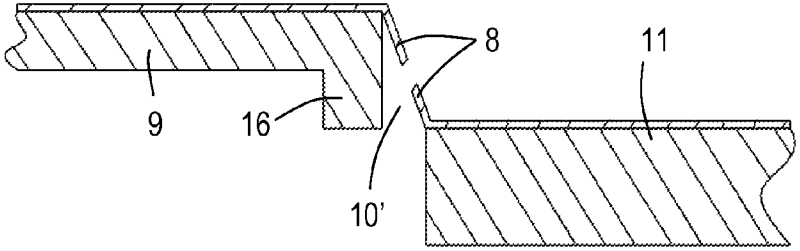
Fig.17D
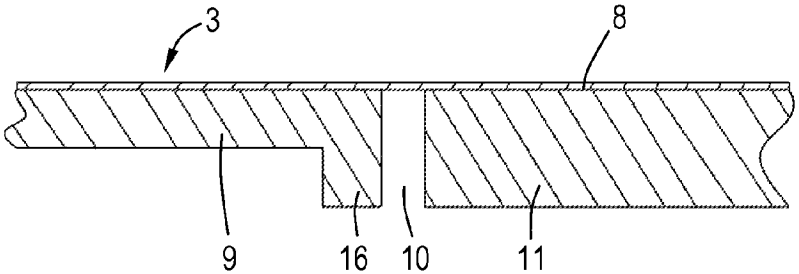
Fig.17C 11
10
16
9
11
10
16
9
O1
O2

CAPSULE, AND METHOD OF PRODUCING IT

CROSS-REFERENCE AND PRIORITY CLAIM TO RELATED APPLICATIONS

This application claims priority to Dutch Patent Application No. 2007417, filed Sep. 14, 2012, entitled "Capsule, and method of producing it" which application is incorporated herein by reference and made a part hereof in its entirety.

FIELD OF INVENTION

The invention relates to a capsule for the preparation of a beverage using an extractable and/or dissolvable product and a quantity of hot and/or pressurized liquid

BACKGROUND

The discussion below is merely provided for general background information and is not intended to be used as an aid in determining the scope of the claimed subject matter.

Such capsules are known for many years in the form of coffee capsules. The first capsules (U.S. Pat. No. 4,136,202) had an aluminium lid comprising a weakness in the form of an incomplete circle such that when the liquid is forced under pressure into the capsule the aluminium should tear at the weakness and a flap inward of the weakness should move away from the remainder of the lid so as to create a large opening through which the beverage could leave the capsule.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted herein.

For the known capsules, a filter was needed to keep the extractable product within the capsule. This opening process of the lid of the capsule was not very reliable with a great variation in opening pressures.

In a further development which is still in use the coffee machine is provided with a relief and in use the lid of the capsule is placed opposite this relief, such that when the capsule is pressurized the lid is deformed against the relief and at a certain pressure the relief is puncturing the lid creating small openings through which the coffee can exit the capsule.

The invention relates to a capsule for the preparation of a beverage using an extractable and/or dissolvable product and a quantity of hot and/or pressurized liquid, comprising a circumferential wall having on one end a bottom adapted to allow entrance of the liquid, and on an opposite end a lid closing said end of the circumferential wall, the circumferential wall, bottom and lid enclosing an inner space containing the product.

The present invention seeks to provide a novel capsule of which at least one of the lid and bottom opens without requiring a relief, knife or other machine part, in particular by using a self controlled, predefined mechanism.

For this purpose the invention proposes a capsule in which at least one of the lid and bottom comprises at least one first portion and at least one second portion separated by at least one slit and having different moving mechanics when under pressure, and comprising at least a layer of tearable material covering said slit.

By providing the lid and/or bottom with first and second portions having different moving mechanics, the first and second portions will move in a different manner when the lid and/or bottom is under pressure, i.e. will move with respect to each other at the position of the slit, in particular due to the liquid entering the capsule for making the beverage, thereby tensioning and finally tearing the layer of tearable material so as to open the bottom and/or lid and allowing beverage to enter and/or leave the capsule. The moving mechanics can be designed such that the lid opens in a reliable and controlled manner.

The rigidity of the first and second portions may be substantially greater than that of the layer of tearable material, so that the layer of relatively more flexible tearable material will be torn in a reliable manner by the more rigid portions.

The moving mechanics of the first and second portions may be such that the at least one first portion at least partly moves with respect to the at least one second portion which may remain substantially stationary when under pressure. In many instances this can be accomplished by making the first portion(s) less rigid than the second portion(s) on at least one position.

The at least first and second portions are partly connected to each other by at least one connection locally bridging or interrupting the at least one slit, allowing the first and second portions to move relatively, but still keeping an interrelationship. Generally, the length of the at least one connection will be small compared to the length of the at least one slit between the first and second portions. The connection or connections may form a bridge between slits or slit portions thereby interrupting the slit locally.

The first and second portions may be interconnected by a plurality of spaced connections determining the relative movement of the first and second portions, so that the tearable material will be torn in a predetermined fashion, especially if the at least one connection between the first and second portions is such that the relative movement between the first and second portion allowed by the at least one connection is maximized in one position and minimized in another position. It is favourable therein that at least a part of the connections act as a stop limiting the relative movement of the first and second parts, thereby providing control over the opening in the lid.

At least a part of the connections may act as a plastically and/or elastically deformable hinge. The hinges make the relative movements of the first and second portions predictable. The shape and/or type of material such as plastic will determine the percentage of plastic and/or elastic deformation and this will determine to what extent the portions will return to their undeformed position after relieve of the pressure within the capsule.

In one embodiment, the lid and/or bottom comprises a plurality of first portions moving independently, and in another one it comprises a plurality of interconnected first portions each having at least a connection to the at least one second portion.

In stead of having a plurality of first portions, it is possible to provide one first deformable portion comprising a plurality of connections to the second portion which are spaced and distributed around the first portion. The deformable portion makes it possible to have several spaced connections and still being movable to tear the tearable material and creating openings in the lid and/or bottom.

If the at least one slit is serpentine shaped or otherwise curved and extending through a large area so as to enlarge its length and be distributed across the area of the lid and/or bottom, it is stimulated that liquid is distributed through the interior of the capsule thereby enhancing contact between the liquid and the extractable and/or soluble product in the capsule.

The at least one second portion may be positioned adjacent to the circumferential wall, so that the relative movement between the portions is effected inwardly of the circumference.

The first and/or second portion may be provided with at least a pointed area bordering the slit and adjacent to the tearable material to facilitate tearing of the tearable material and to further control the pressure at which this will happen.

If there is a hinge between the first and second portions, the pointed area may be positioned at a distance from the hinge, and particularly where the first and second portion obtain a maximum relative movement when under pressure, so that the tearing will be initiated in a reliable and controllable way.

The first and second portions can be made mainly of plastic material which allows easy shaping of the lid and/or bottom and creating different moving mechanics.

The layer of tearable material may be made from a foil, in particular from a non-plastic material, or a laminate of plastic and non-plastic material in order to create the desired tearing and other characteristics. The foil may be permanently attached to at least a part of the inner or outer surface of the first and second portions.

In one embodiment, the layer of tearable material is made mainly from a metal, in particular aluminium foil attached to the first and second portions and preferably covering at least a substantial part of the lid and/or bottom. Aluminium has the desired tearing characteristics, and the characteristics can be adjusted by laminating it with other materials.

The first or second portions may be provided with stiffening members, such as stiffening ribs to influence the moving mechanics. These stiffening members may be provided on the inside or outside of the lid. These stiffening members, especially those on the outside of the lid, may also be used to allow a portion of the lid to be supported by a machine part so as to prevent unwanted deformation of certain parts of the lid, for example the second portion thereof.

At least the at least one first portion of the lid and/or bottom may be concavely shaped in order to create room within the circumscribing planes to move.

At least the at least one first portion of the lid may be adapted to be moved from a concave to a, preferably stable, convex shape when under pressure from the inner space of the capsule.

The surface area of the at least one first portion is for instance more than 30%, preferably more than 50%, and more preferably more than 70% of the total area of the lid and/or bottom defining the inner space in order to create sufficient forces on the first portion to effect the desired movement and tearing of the tearable material at the pressure that is available.

The lid and/or bottom may be provided with an entry/exit filter at least at the position of the slits to keep non-liquids within the inner space if the openings created do not serve themselves as filter. This filter may be provided internally or externally of the lid and/or bottom.

If the relative movement between the first and second portions relative to the thickness of the first and second portions at the position of the at least one slit is so small that the first and second portions may remain overlapping in their direction of movement in the opened position of the lid and/or bottom during use. Thus, in this embodiment, the slit is maintained, so that the relative movement between the first and second portions is mainly used for tearing the tearable layer, not for creating an exit opening between the first and second portions, but maintaining one that is already there but is closed by the layer of tearable material. If the slit is then sufficiently narrow, it may act as a filter itself. The thickness of at least one of the first and second portions may be increased next to the slit in order to allow sufficient movement between the first and second portions and still maintain an overlap and allow the slit to act as a filter.

In order to maintain a substantially constant slit width and prevent relative movements between the first and second portions within their main plains, at least one of the first and second portions may include a plurality of local protrusions distributed over the length of the at least one slit and protruding towards the other of the first and second portions, and preferably extending the thickness of the first or second portion. Other formations in the slit may influence the behaviour of the particle bed at the position of the slits, to prevent the particles from escaping from the capsule. For example, it is favourable to create small domes within the particle bed above the slits instead of a long arched vault which is more prone to collapsing and thereby escaping of particles from the bed. The creation of these domes might be promoted for example by formations on deepened ridges within the slits or meander-shapes of the slits.

In a particular embodiment, the lid and/or bottom is part of a separate element that is attached to the circumferential wall of the capsule, for example by at least one of the group of welding, heat sealing, gluing and mechanically connecting. In this embodiment the lid and/or bottom may be formed independently from the remainder of the capsule according to their desired characteristics and then being attached thereto.

The separate element may include a circumferential rim part connecting to the circumferential wall and extending outwardly beyond it at an angle thereto. This rim part may be provided with a ring-shaped seal on its side facing the bottom of the capsule. This seal may for example be a swellable seal, which is attached to the rim, for example by adhesive.

The circumferential wall and bottom may be made either of plastic material or mainly of aluminium.

The invention also includes a capsule for the preparation of a beverage using an extractable or dissolvable product and a quantity of hot and/or pressurized liquid, comprising a circumferential wall having on one end a bottom adapted to allow entrance of the liquid, and on an opposite end a lid closing said end of the circumferential wall, the circumferential wall, bottom and lid enclosing an inner space containing the extractable or dissolvable product, wherein the lid and/or bottom is made at least partly of plastic and being part of a separate element attached to the circumferential wall.

The separate element may be provided with a circumferential rib fitting into the inner space and being adapted to the shape of the circumferential wall so as to act as a centering means.

The circumferential wall may be provided with a rim portion fitting onto the rim part of the separate element, the separate element being fixed and sealed to the circumferential wall at least at the position of the rim part.

The invention also includes a method of producing a capsule for the preparation of a beverage using an extractable or dissolvable product and a quantity of hot and/or pressurized liquid, comprising a circumferential wall having on one end a bottom, and on an opposite end a lid closing said end of the circumferential wall, the lid and/or bottom being made at least partly of plastic and being part of a separate element attached to the circumferential wall, as well as a seal, the method including the steps of making the circumferential wall and bottom, the lid and the seal, bringing these elements together and interconnecting them, preferably in one step.

BRIEF DESCRIPTION OF THE DRAWINGS

Further details and advantages of the invention will follow from the below description with reference to the drawing showing embodiments of the capsule.

FIGS. 14A-14C, 15A-15C, 15D-15F, 16A-16E and 17A-17D are views corresponding to that of FIG. 5A-5C but showing different embodiments.

DETAILED DESCRIPTION

Figure 1:
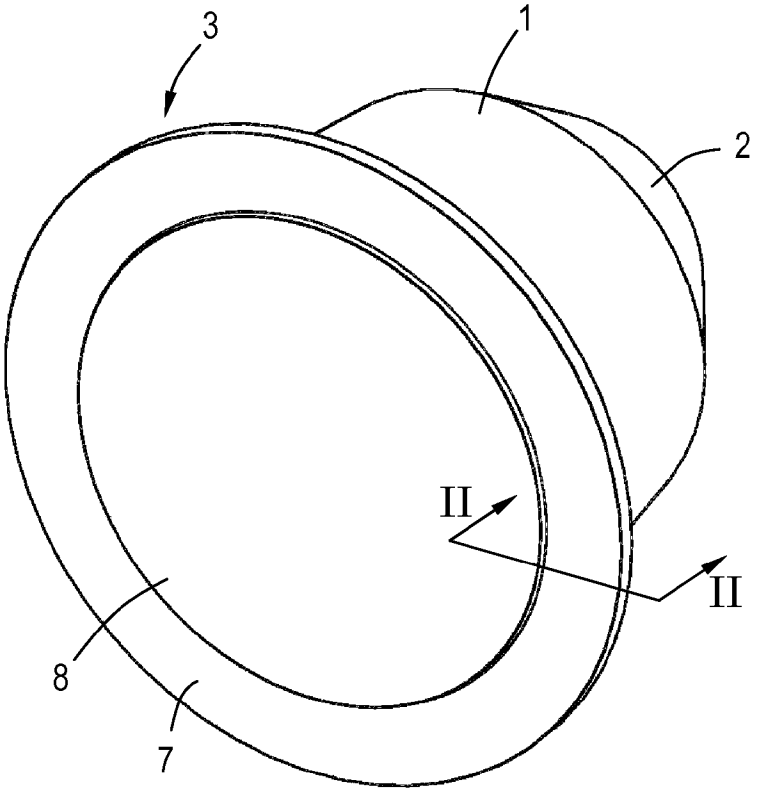
FIG. 1 is a simplified perspective view of a capsule.

FIG. 1 shows a capsule for use in a beverage producing device, in this case an espresso coffee machine. For this purpose the capsule is filled with an extractable or soluble product, i.e. ground coffee. Other products could include tea, chocolate, soluble coffee, vin chaud, soup or milk powder or the like. The product contained in the capsule is normally sufficient to make one cup of the beverage, but could also be sufficient to make several cups, or to make just a part of the complete beverage.

The capsule comprises a circumferential wall 1, here in the form of a frusto-conical wall having a circular cross section, but any cross or longitudinal section would be conceivable depending on the device in which the capsule is to be used. The circumferential wall 1 is closed on one end by a bottom 2 and on the opposite end by a lid 3. The circumferential wall 1, bottom 2 and lid 3 enclose an inner space 4 containing the extractable or dissolvable product, such as ground coffee.

The bottom 2 can have any shape, flat, convex, concave or combinations, and may also be very small if the circumferential wall is very conical. The bottom 2 is adapted to allow the entrance of hot and/or pressurized fluid, in particular water. For this purpose the bottom 2 is formed such that it can be pierced or cut to form one or more entrance openings, or is already provided with one or more entrance openings that are open or openable, for example being provided with a valve, or a peel-away foil.

The lid 3 in this embodiment is formed as part of a separate plastic element 5 attached to the circumferential wall 1. The separate element or inlay 5 may comprise a circumferential rib 6 fitting into the wide opening of the frusto-conical wall 1 and thus centering both parts 1 and 5 relatively. In this embodiment, the circumferential wall 1 is formed with a rim portion 1' extending at an angle to the wall 1 and being coplanar with a respective rim part 7 of the inlay 5 so as to fit onto each other. The rim portion 1' could be used to attach the inlay 5 to the wall 1 in an airtight manner.

The lid 3 further includes a layer of tearable material 8, in this case a foil 8, in particular a metal, more particularly an aluminium foil 8, in this case securely and permanently attached to the outer side of the inlay 5, i.e. facing away from the inner space 4. The foil 8 could also be permanently attached to the inner side of the inlay 5 or could be integrated in the inlay, i.e. sandwiched between two plastic layers of the inlay 5. This foil 8 acts as a tearable layer of the lid 3. The foil, in particular aluminium foil 8 is very flexible, i.e. bendable, but will hardly stretch, so that it will tear when a pulling force is exerted on it by the first and second portions 9, 11.

The inlay 5 includes one or more first portions 9 which are separated to a large extent from a second portion or second portions 11 of the inlay by at least one slit 10. This slit 10 is preferably as narrow as possible, normally determined by the production process. It may have a constant width, for example in the order of 0.1-2 mm, or more particularly 0.3-1.5 mm. The width of the slit may also decrease in the direction of outflow of the liquid, i.e. along the height of the slit to create a tapered cross-section.

Figure 2:
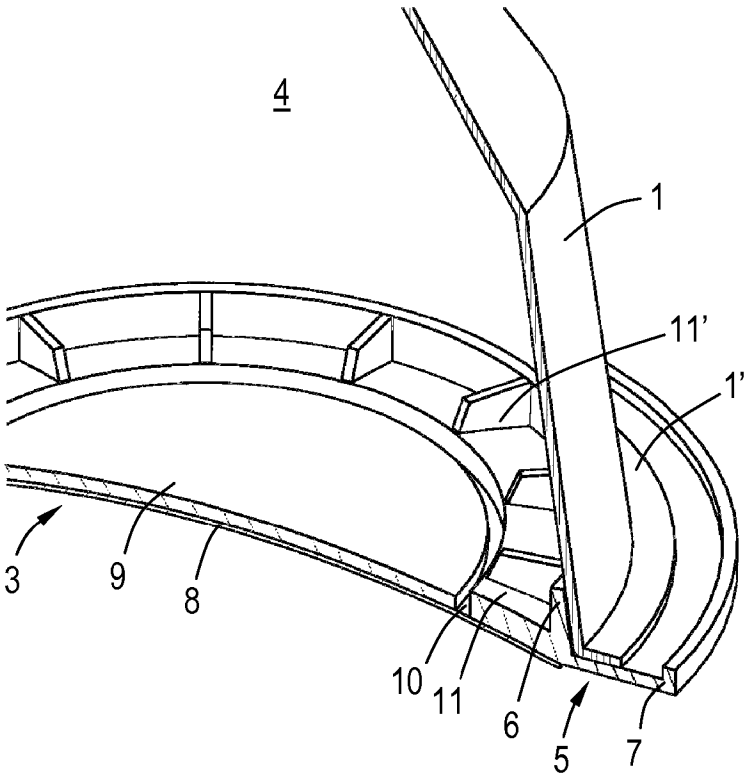
FIG. 2 is an enlarged perspective sectional view according to the line II-II in FIG. 1.
Figure 3:
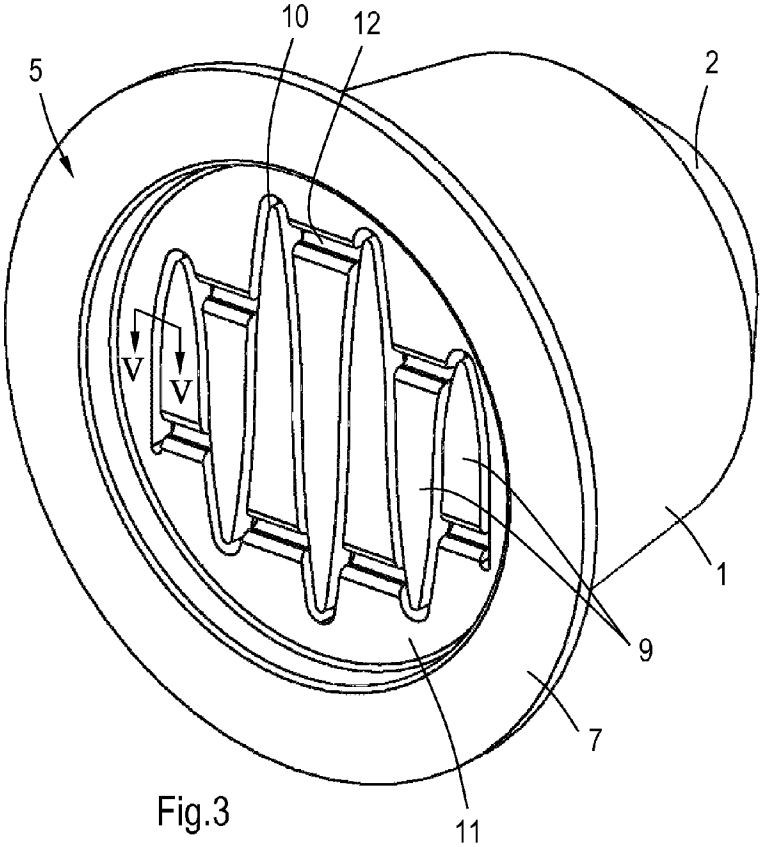
FIG. 3 is a view of the capsule corresponding to that of FIG. 1, but with the external foil removed.
Figure 4:
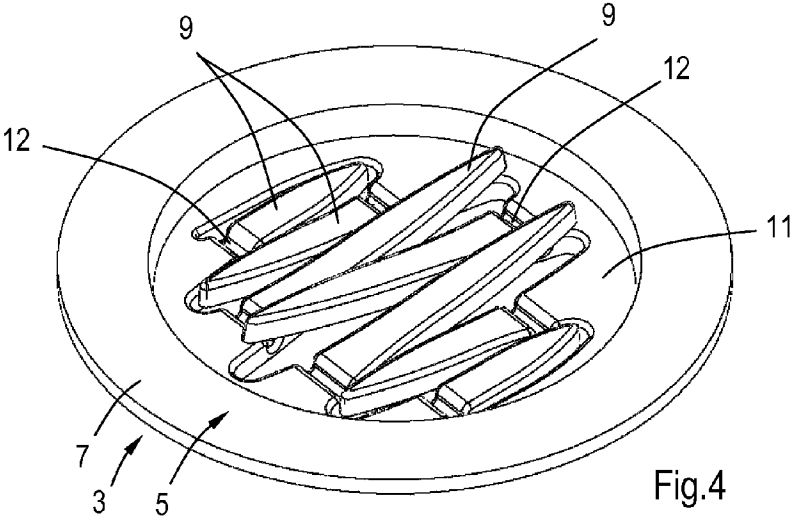
FIG. 4 is a perspective view of the lid of the capsule of FIG. 3 after the lid has been opened under pressure.

In the embodiment of FIGS. 3, 4, there is a zig-zag shaped slit. Due to this shape of the slit 10, the first portions 9 are in the form of fingers lying next to each other but being attached to the second portion 11 of the lid 3 on opposite sides only. The first portions 9 and the second portion 11 have different moving mechanics, which means that if pressure is exerted on the lid from inside the capsule, they wish to move differently so that a relative movement is effected thereby creating a force on the foil 8. In this embodiment, the first portions 9 are attached to the second portion 11 of the inlay 5 through hinges 12, such as integrated live hinges or other portions that are more deformable than the fingers itself, so that the first portions 9 will make a pivoting movement when they are loaded. The first portions 9 may have a smaller thickness than the second portion 11 of the inlay 5 but this is not necessary, especially not if all deformation is concentrated in the live hinges 12 having a reduced thickness in comparison with the first portions 9 and second portion 11 of the lid 3. The thickness of the first and second portions may vary over the area, for example depending on the desired moving mechanics and the required thickness next to the slits. FIG. 2 shows that the second portion 11 is provided with radial ribs 11' to increase the rigidity of the second portion 11 and thus to reduce its movement under pressure. In this embodiment, the slit or slits 10 are not only positioned between the first and second portions 9, 11, but may also define individual first portions 9 moving differently.

Due to the foil 8 being attached to the lid 3 and thereby connecting the first portions 9 and the second portion 11 of the inlay 5, and thus completely covering or bridging the slits 10, the lid 3 is fully closed. Since also the circumferential wall 1 and the bottom 2 are closed the contents of the capsule are sealed from the outside. If all materials have the desired barrier characteristics, the product in the capsule can be kept fresh for a longer period of time. If one of the parts of the capsule is not fully closed, an outer packaging or removable seal may be used to provide the barrier and guarantee freshness. If freshness is not an issue, such seal or outer packaging may be omitted.

Figure 5A:
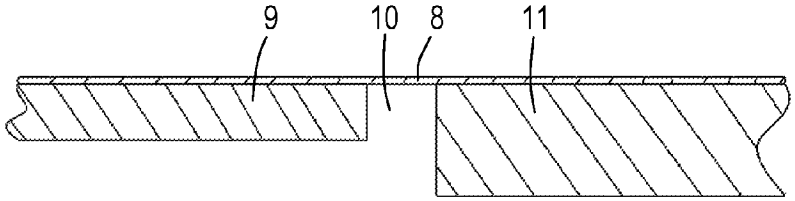
FIGS. 5A, 5B, and 5C are enlarged sectional views of a part of the lid according to the line V-V in FIG. 3, in three positions of use: (1) unpressurized, (2) pressurized, but still closed, and (3) opened.
Figure 5B:
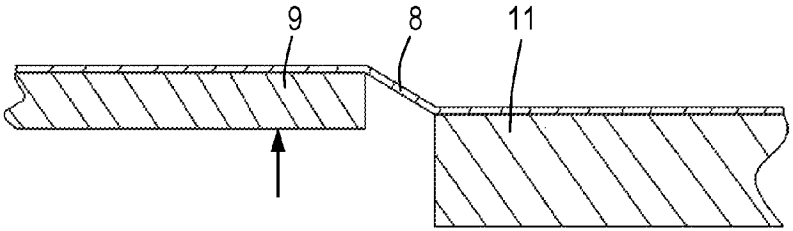
Figure 5C:
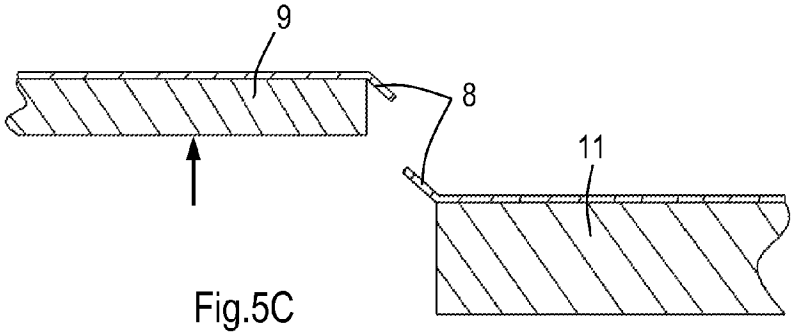

The foil 8 covering the slits forms a tearable material in the lid 3, i.e. being weaker than the first portions 9 and the second portion 11 of the lid 3, see also FIG. 5A. This means that if a pressure is exerted on the lid 3 from the inner space 4 of the capsule, the first portions 9 will try to move away from the inner space, in this case by pivoting around the hinges 12. This movement is first substantially prevented by the foil 8 forming the tearable material that connects the movable portions 9 to the second portion 11 of the lid 3 that in this case hardly moves due to its rigidity (FIG. 5B). If the pressure in the inner space 4 rises sufficiently, the lid 3 will open at the position of the foil 8 because the force exerted by the first portions 9 on the foil exceeds the maximum strength thereof, in this case because the foil 8 will break or tear (FIG. 5C). Because it will take some time for the pressure in the inner space 4 to build up, the hot water introduced into the inner space has time to contact the ground coffee and exert pressure thereon so that a good extraction of the coffee is achieved.

The lid 3 will be designed such that it will open in a reproducible manner at a given pressure when water of a given temperature is injected. There are many design variations to influence the opening pressure of the lid 3. Not only the strength of the tearable material determines the opening pressure but also its size as well as the shape. The surface area and rigidity of the first portions 9 will also be an important factor relative to the shape, surface and rigidity of the second portion 11 and the number and position of the attachment points or connections between these, defining the mechanics of their relative freedom for displacement. As mentioned, the shape is important: if a pointed area is formed bordering the slit 10 and adjacent to the foil 8, in particular in a position substantially opposite to the respective hinge 12, the pointed area will induce tearing of the foil 8 at that position due to a notch effect. The effect will be maximized if the pointed area is rigid and is positioned on the side of the foil 8 to which it pulled at that position. The fingers forming the first portions 9 in FIG. 4 indeed have sharp tips which will reduce the maximum pressure in comparison to the situation in which the fingers would have rounded tips. The sharp tips lie on the inner side of the foil 8 and the foil is pulled inwardly by the second portion 11 which remains substantially stationary while the first portions 9 move outwardly. Each of these measures may be used in combination with the above. After the first breakage of the foil 8, it will continue tearing along the slits up to a point where there is no movement between the first and second portions 9, 11 and/or where it is permanently attached to the lid 3.

Openings for the beverage to exit the capsule are created between the fingers of the first portions 9 and the second portion 11 of the lid 3, wherein the openings are at a maximum at the tips of the fingers. The size of the openings will depend on the pivoting movement of the fingers, which will depend on the characteristics of the hinges 12, i.e. their resistance against bending, the percentage of elastic versus plastic deformation in the hinges 12. The latter will depend to a large extent on the behavior of the material of the inlay 5 under influence of pressure and temperature, and in particular of the hinges 12 therein, although they will generally be of the same material. The (local) thickness and shape of the material will influence the moving mechanics. Materials for the inlay, which will generally be made by injection moulding, include for example PET, PS, PP and such plastics. The fingers of the first portions 9 could also be provided with stops or other means to limit the movement of the fingers, especially at the position where the largest movement is caused, so as to limit the opening created between the first and second portions 9, 11.

Depending on the size of the openings created next to the first portions 9 there will be made use of a filter or not. The first and/or second portions 9, 11 surrounding the slits 10 may be provided with integrated hair-like tips, acting as a filter. Filter material, for example paper, may also be added. The filter could be placed internally of the lid 3, either attached at least to the remainder of the lid or separate thereof, or externally of the lid, such that the movement of the first portions 9 is not hindered by the filter.

The foil 8 should be firmly attached, for example glued or heat-sealed, to the first portions 9 and especially to the second portion 11 of the lid 3 to prevent it from becoming delaminated when the first portions 9 push the foil 8 outwards away from the second portion 11 of the lid 3 when pressurized. The foil 8 could also be laminated between plastic layers of at least the second portion 11 of the lid 3 to prevent delamination.

Figure 6:
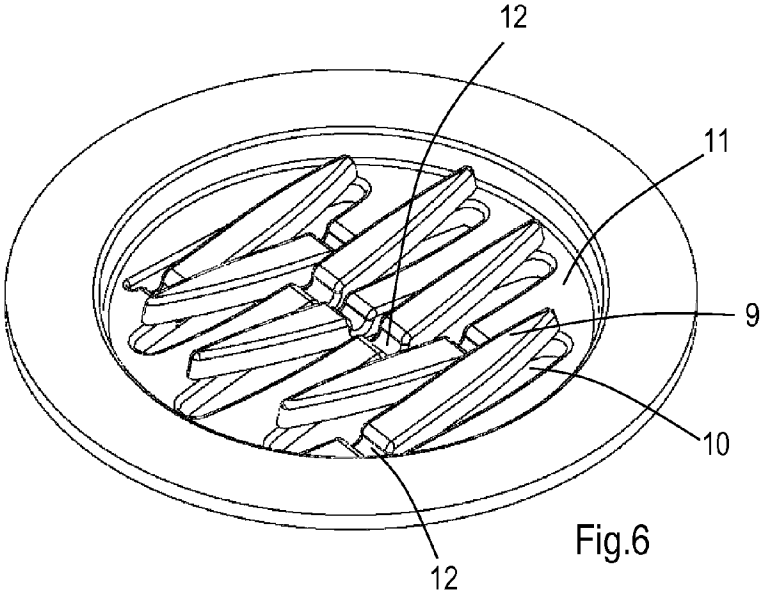
FIG. 6 is a view corresponding to that in FIG. 4 but showing a slightly different embodiment.

FIG. 6 shows another embodiment of the capsule lid 3 in which the position of the hinges 12 has been changed, such that now the first portions 9 all have substantially the same length, thereby equalizing the force exerted on the foil 8 when there is pressure in the inner space 4. The hinges 12 of the three central first portions are substantially aligned and could be interconnected to enhance the rigidity of the second portion 11. In that case, the slit 10 would be interrupted.

Figure 7:
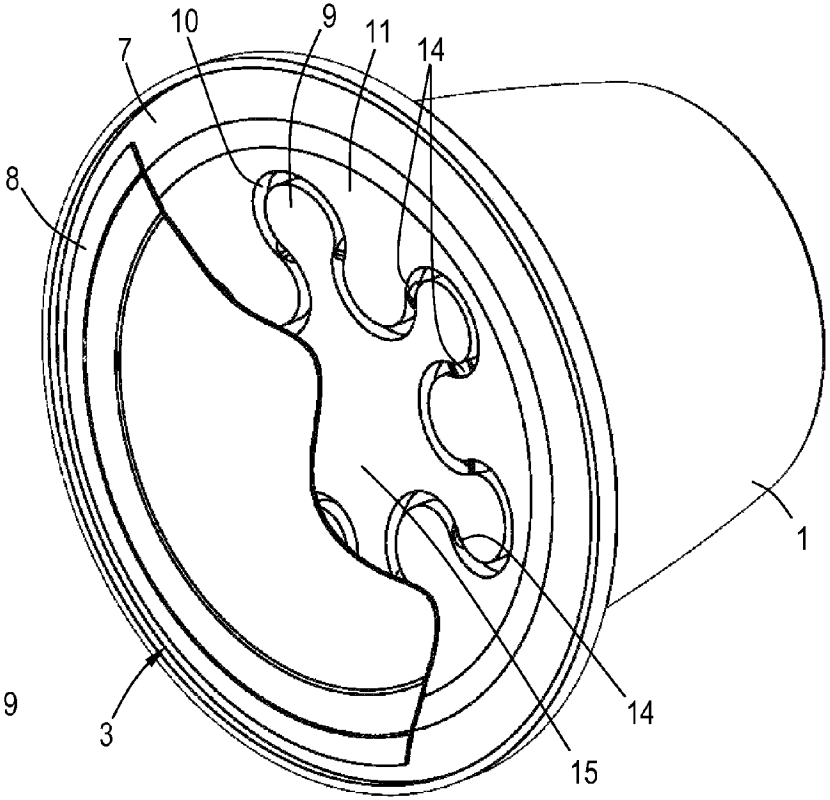
FIGS. 7 and 8 are views corresponding to those of FIGS. 3 and 4 but showing another embodiment of the capsule, and wherein the external foil is shown in a partly cut-away manner.
Figure 9:
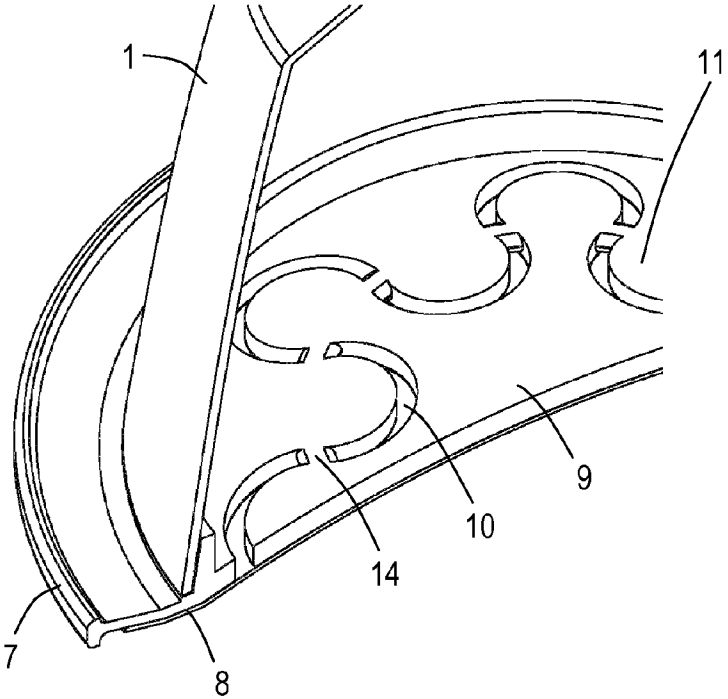
FIG. 9 is an enlarged, perspective cut-away view of a part of the capsule of FIG. 7.
Figure 8:
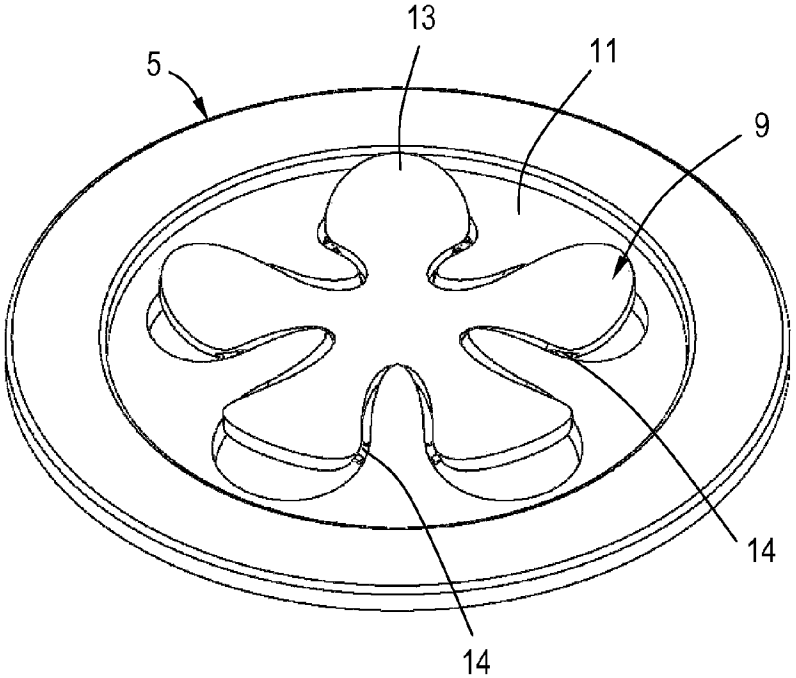

FIGS. 7-9 show a further embodiment of the lid 3 of the capsule. Here the slit 10 defines a star or flower-like shape having a plurality of first portions 9 in the form of radial petals or leaves 13. In fact the slit 10 is not continuous but is interrupted by connections 14 approximately halfway the leaves 13 on both sides thereof, these connections 14 forming a local bridge between the first portions 9 and the second portion 11 of the lid 3 (see FIG. 9). The connections 14 can be positioned in specific ways to determine the movement of the first portions 9. Here the first portions 9 are interconnected and form one deformable part that can move with respect to the second portion 11 of the lid 3. Due to the co-operation between the first portions 9, the connections 14 thereof allow only a defined, limited movement of the first portions 9 with respect to the second portion 11 of the lid 3.

The central part of the inlay 5 inward of the circumferential rib 6 is concavely shaped with respect to the capsule, so that the first portions 9 can move outwardly without or hardly protruding axially beyond the rim part 7 of the inlay 5.

When there is a pressure in the inner space 4 of the capsule, the outer ends of the leaves 13 of the deformable parts wish to move away from the inner space, and when the foil 8 is torn by the first portions 9, the first portions 9 will take the shape as is shown in FIG. 8. Depending on the rigidity of the parts of the second portion 11 of the lid 3 extending between the leaves of the first portions 9, these may remain undeformed or may be deformed outwardly to a limited extent. The connections 14 will undergo a bending and twisting deformation.

Figure 11:
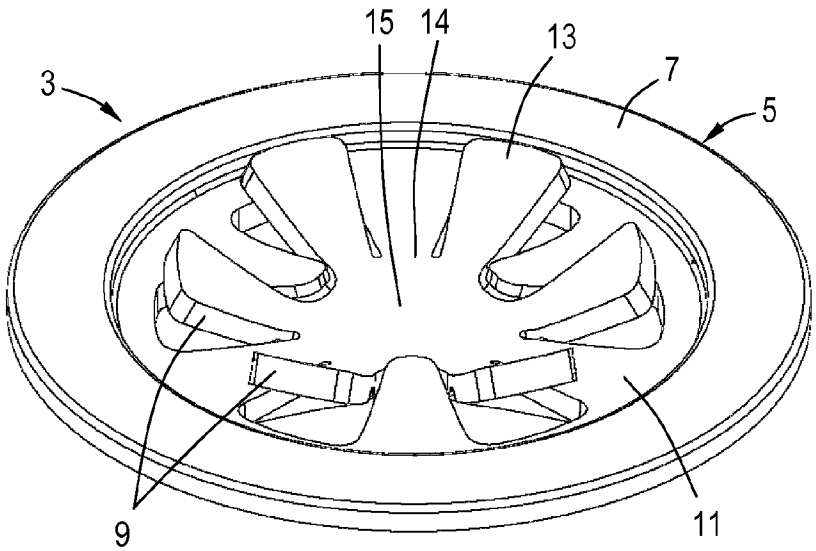
FIGS. 10 and 11 are views corresponding to those of FIGS. 3 and 4 but showing still another embodiment of the capsule.
Figure 10:
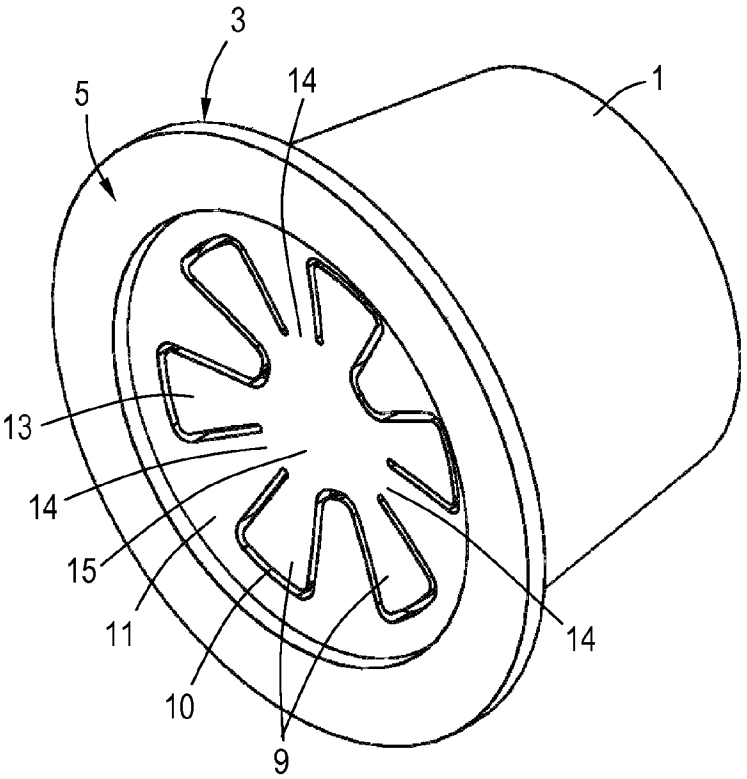

FIGS. 10 and 11 show yet another embodiment, similar to that of FIG. 7, 8 but having six leaves 13 which are trapezoidally shaped with the longest base at their free ends. The connections 14 between the first portions 9 and the second portion 11 of the lid 3 are not positioned at the leaves 13, but at the position between the leaves, i.e. at the edge of a core 15 of the flower-shaped deformable part 9. As a result, the leaves 13 of the first portions 9 are free to pivot outwardly, wherein their hinge 12 is positioned between the connections, where the cross section of the leaves 13 is minimum. So in this embodiment the thickness of the hinge 12 does not have to be reduced with respect to the rest of the first portions 9. In this embodiment, the connections 14 only bend and do not twist.

Figure 12A:
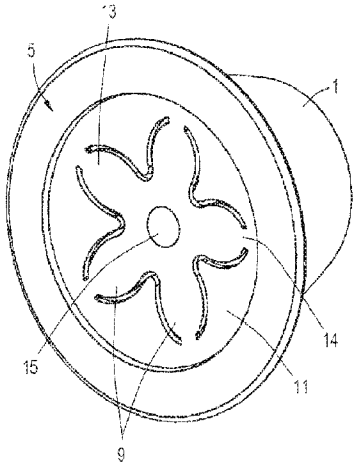
FIGS. 12A and 13A are views corresponding to those of FIGS. 3 and 4 but showing yet another embodiment of the capsule.
Figure 13A:
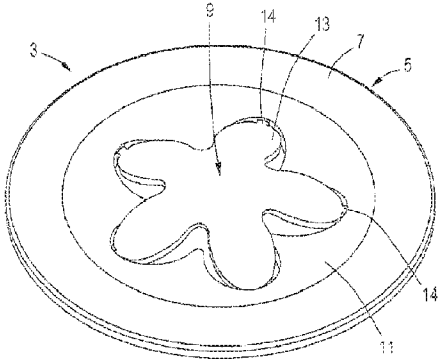

FIGS. 12A, 13A show still another embodiment in which there is more or less one first portion 9 forming a flower shape having a number of leaves 13. In this embodiment, the first portion 9 is connected to the second portion 11 of the lid through connections 14 that are positioned at the tips of the leaves 13. Thus, the core 15 of the first portion 9 is free from the second portion 11 of the lid and thus can move relative thereto. Also in this embodiment, the part of the inlay 5 inwardly of the rib 6 is concavely shaped in unloaded condition, but when the pressure exceeds a threshold and the foil 8 on the lid 3 is torn by the first portion 9, the core 15 of the first portion 9 will move from a concave shape to a convex shape, which is stable so that it will remain also after the pressure has been relieved.

Openings for the beverage to exit the capsule are created at the complete unconnected circumference of the first portions 9. If the first and second portions 9, 11 have a thickness adjacent the slit 10 such that in the convex shape of the first portion 9 the first and second portions still overlap each other in a direction perpendicular to their plane and thus in the direction of movement of the first portion 9, the openings created are determined mainly by the width of the slit 10 only. A filter might then not be needed if the slit has a sufficiently small width. The thickness of the first and/or second portion can be locally increased adjacent to the slit 10 by providing a rib on the surface of the first and/or second portion 9, 11 following the slit and thus the circumference of the first and/or second portion.

Figure 12B:
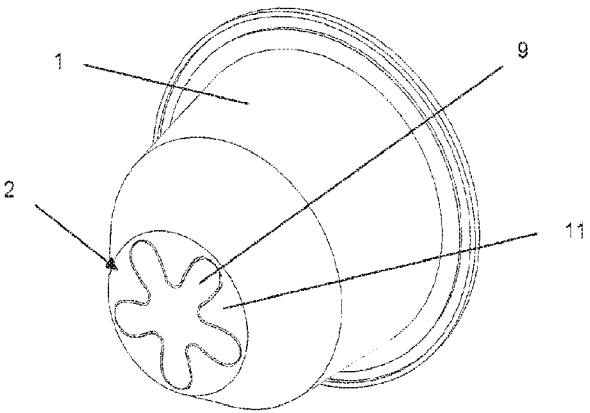
FIGS. 12B and 13B are perspective views of the bottom of a further embodiment of a capsule in closed and opened position.
Figure 13B:
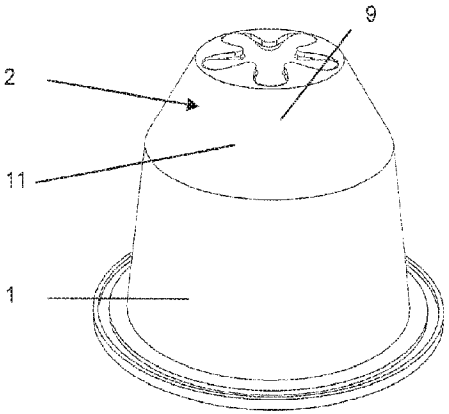

FIGS. 12B, 13B show yet another embodiment in which the bottom 2 has a structure that is comparable to that of the lid 3 of FIGS. 12A, 13A. This means that the first and second portions 9, 11 of the bottom 2 are used to open the capsule on the inlet side in order to allow entry of liquid into the capsule. It is then not necessary to provide an espresso machine with knives or other opening tools to open the capsule on the inlet side. No outer packaging is necessary either. Of course, the first and second portions 9, 11 and layer 8 of tearable material (on the inside) will be chosen such that the inlet will be opened at a lower pressure, so that water can enter the capsule quickly and pressurize the capsule to a level at which the lid 3 will open as well. The inlet will open over a large area so that the contents of the capsule will be evenly wetted. Such bottom 2 may be a separate part, but can also be integrated in the piece including the bottom 2 and circumferential wall 1, as is shown here. The tearable material 8 may be provided on the inner and outer side of the bottom 2. The first and second portions 9, 11 of the bottom may also be conceived like the other embodiments of the lid 3.

In all the embodiments described above, the slit 10 is more or less serpentine shaped or otherwise curved over a large area of the lid, so that the length of the slit is relatively long and is crossing the area of the lid, so that the opening(s) created when brewing the beverage are distributed over the surface of the lid. Liquid will thus be stimulated to spread over the contents of the interior of the capsule so that an intense contact between the liquid and the product in the capsule is ensured.

FIGS. 14-19 show various variations of the lid of the capsule, especially in relation to the slits 10 and surrounding parts.

Figure 14A:
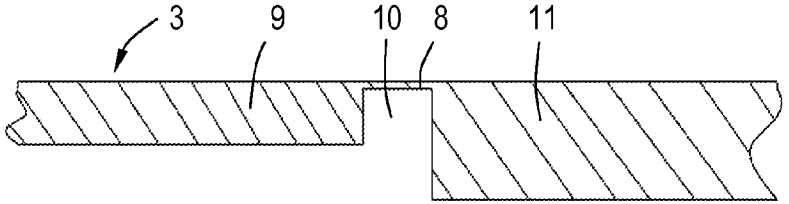
Figure 14B:
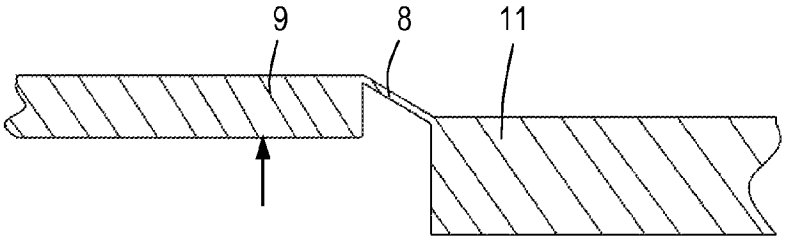
Figure 14C:
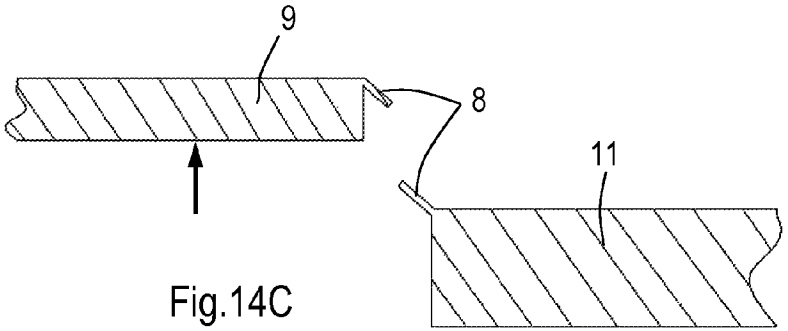

FIGS. 14A-14C are views corresponding to that of FIGS. 5A-5C but showing an embodiment in which the layer 8 of tearable material covering the slit 10 is formed integral with the first and second portions 9 and 11, for example by means of injection moulding. Because this layer 8 is much thinner than the portions 9 and 11, it forms a weakened zone and if force is exerted on the lid 3, it will tear at the layer 8 if the first portion 9 moves relative to the second portion 11. The manner of tearing and creating an opening for the beverage is similar to that of FIGS. 5A-5C. This integrated layer 8 of tearable material may also be positioned for example at the inner surface of the first and second portions 9, 11. It will then still cover the slit from the inside. Pointed areas will create places where tearing will be initiated if pressure is exerted by the layer 8 on this pointed area.

Figures 15A, 15B, 15C:
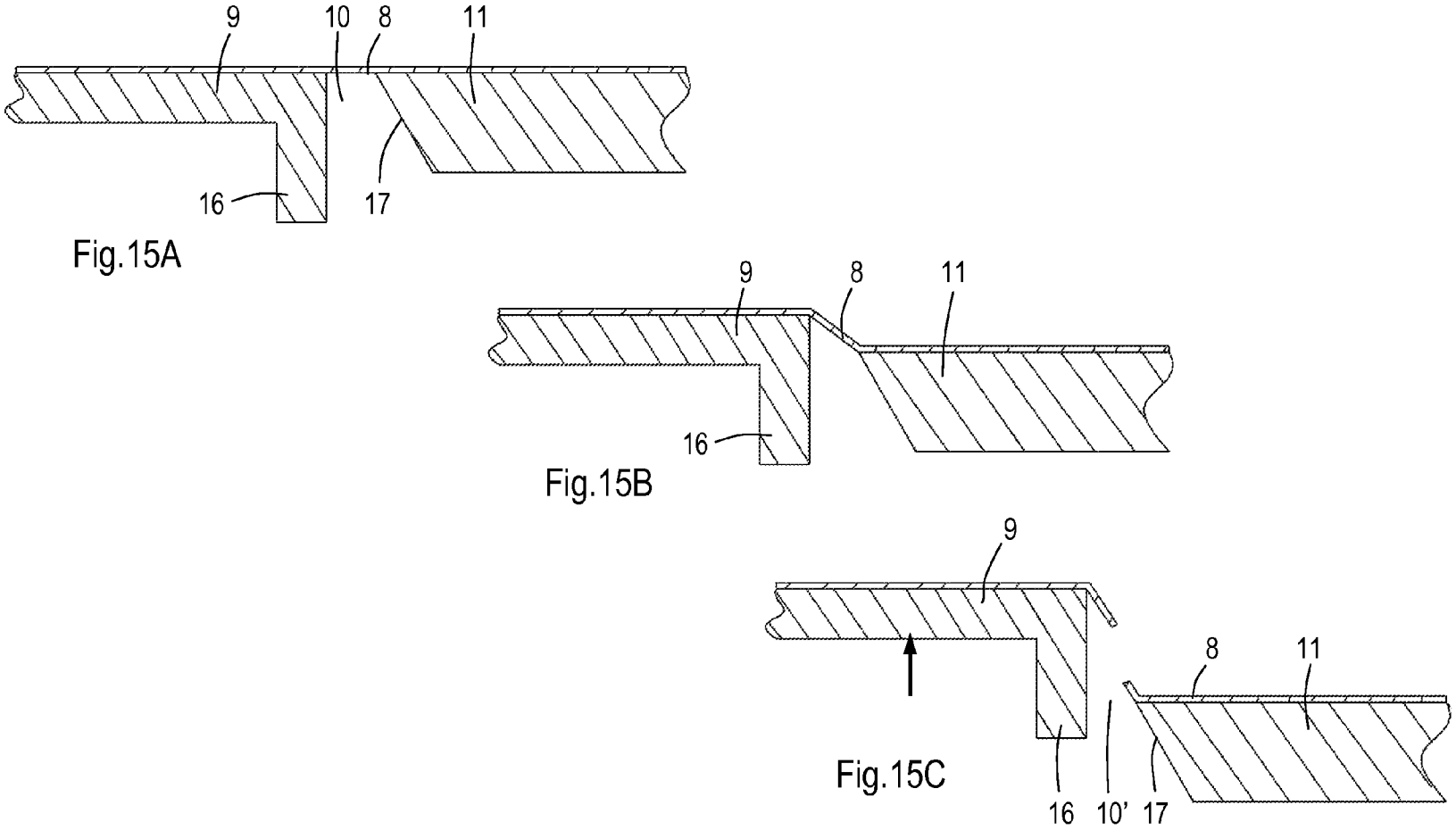

In the embodiment of FIGS. 15A-15C the layer 8 is again formed by a foil, but the edges of the first and second portions 9, 11 defining the slit 10 are formed differently. As mentioned before, there is formed a rib 16 on the surface of the first portion 9 causing both portions 9 and 11 to remain overlapped in opened condition, see FIG. 15C, so that the opening 10' between portions 9 and 11 remains narrow and act as a filter for solid particles. An edge 17 of the second portion 11 adjacent the slit 10 has been bevelled to create a very narrow slit 10 (smallest cross section) on the one hand and allows injection moulding with a sufficiently strong mould on the other hand.

Figure 15F:
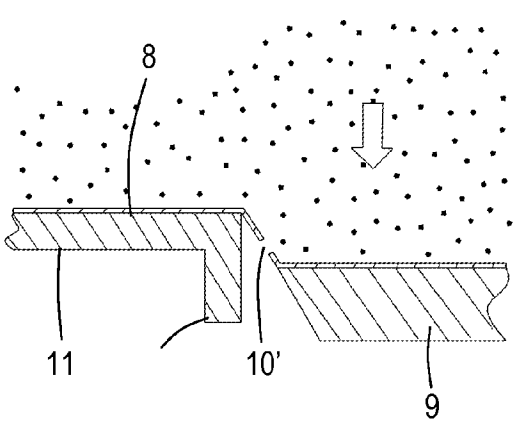
Figure 15E:
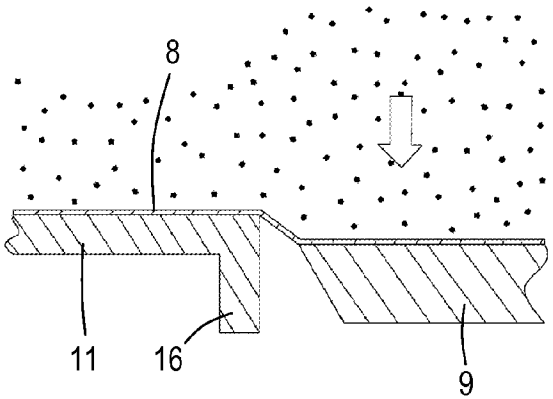
Figure 15D:
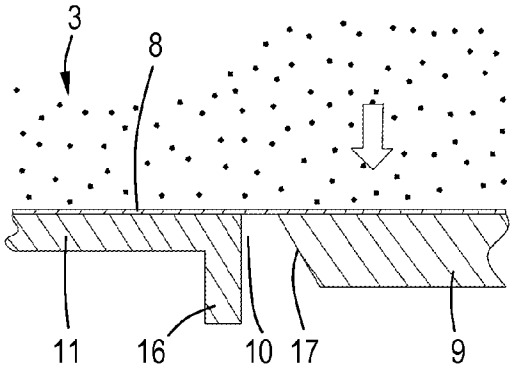

FIGS. 15D-15F show an alternative embodiment of FIGS. 15A-15C. In the new embodiment, the foil 8 is provided on the inner surfaces of the first and second portions 9 and 11 (the inner side is now on the upper side instead of on the lower side as in FIG. 15A-C). The rib 16 is formed on the outer surface of the second portion 11, and still causes both portions 9 and 11 to remain overlapped in the open condition of the lid 3. On the other hand, the edge of the first portion 9 has bee bevelled to create the smallest opening 10' of the slit 10. The principled of the first embodiments therefore remain the same but the other way around.

Figure 16A:
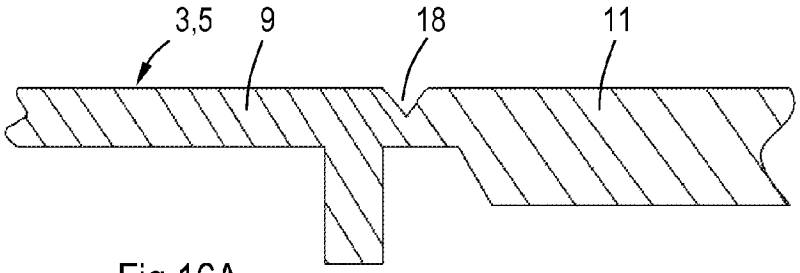
Figure 16B:
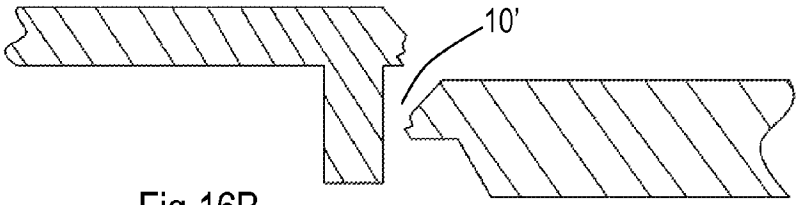
Figure 16C:
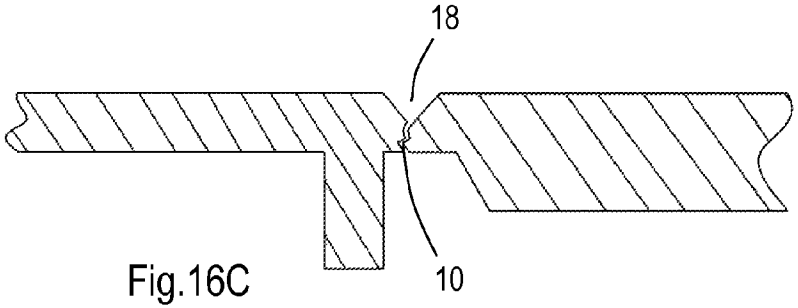
Figure 16D:
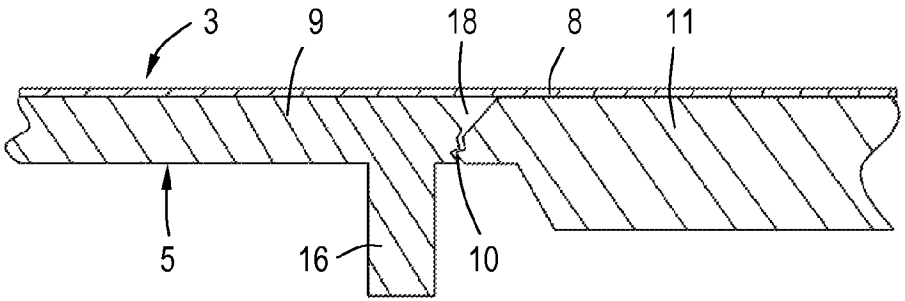
Figure 16E:
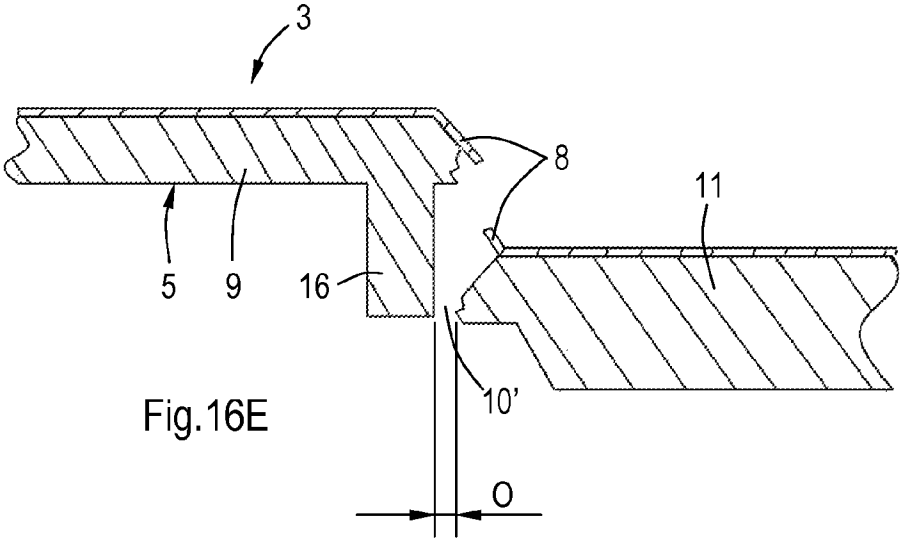

FIGS. 16A-16E illustrate a manner of producing a further embodiment of the lid 3. FIG. 16A shows an intermediate product in which the inlay 5 of the lid 3 is formed with the portions 9 and 11 connected to each other along the length of the slit 10 or opening 10' to be formed. At the position where the slit 10/opening 10' should be formed, there is created a V-groove 18 in the outer surface of the lid 3 forming a weakened area 18'. FIG. 16B shows that during production the parts 9 and 11 are separated from each other at the position of the V-groove 18. This is done by loading the lid after forming the inlay 5 in order to create the slit 10. FIG. 16C illustrates that after bringing back the inlay 5 in the undeformed position thereof the slit 10 is formed by the tear or crack in the plastic material and is therefore very narrow. In FIG. 16D, the lid 3 has been finished by attaching the foil 8 to the inlay 5 forming the cover of the slit 10. By slightly off-setting the rib 16 with respect to the bottom of the V-groove 18, there is created a distance between the edge 17 of the second portion 11 and the side of the rib 16 so as to allow unhindered movement of portions relative to each other and to create an opening 10' having the desired dimension O as indicated in FIG. 16E.

In the embodiment of FIG. 17A-17D, the inlay 5 of the lid 3 is formed with the first portion or portions 9 in a deformed position. This makes it possible to put the division between the mould halves M1 and M2 at the plane between the first and second portions 9, 11 thereby obviating the need of a rib in one of the mould halves M1 or M2 or at least reducing the maximum height of this rib. Before the foil 8 is attached to the inlay 5 (FIG. 17C), the first and second portions 9, 11 are brought to their position in which the outer faces of the portions 9, 11 are substantially flush (FIG. 17B). FIG. 17D shows the position of the portions 9 and 11 after the pressure within the capsule has deformed the lid 3, and this position substantially corresponds to the position of the portions during manufacture.

Figure 18A:
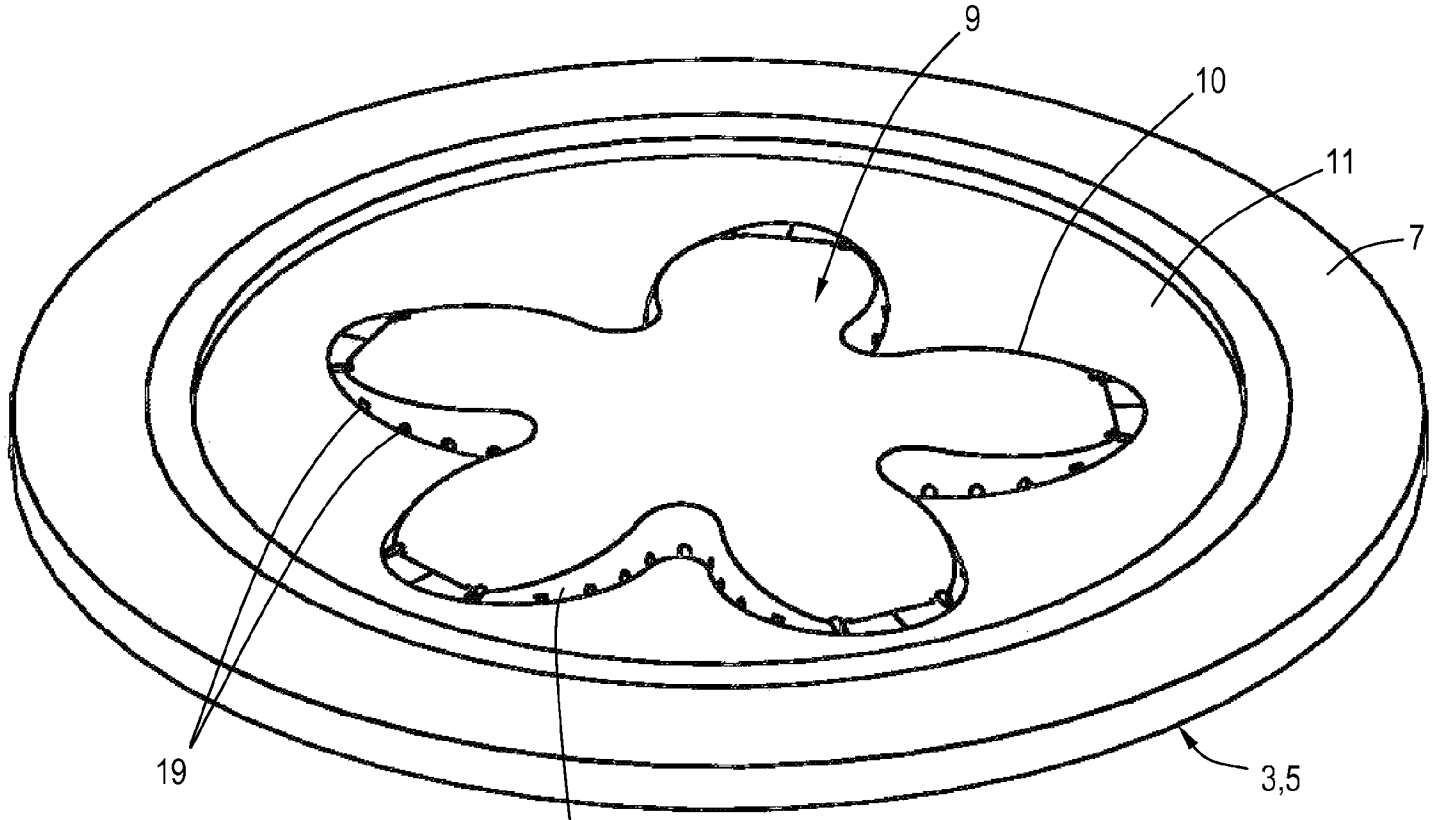
FIGS. 18A, 18B are perspective views showing the lower and upper side of an embodiment of an insert of a capsule.
Figure 18B:
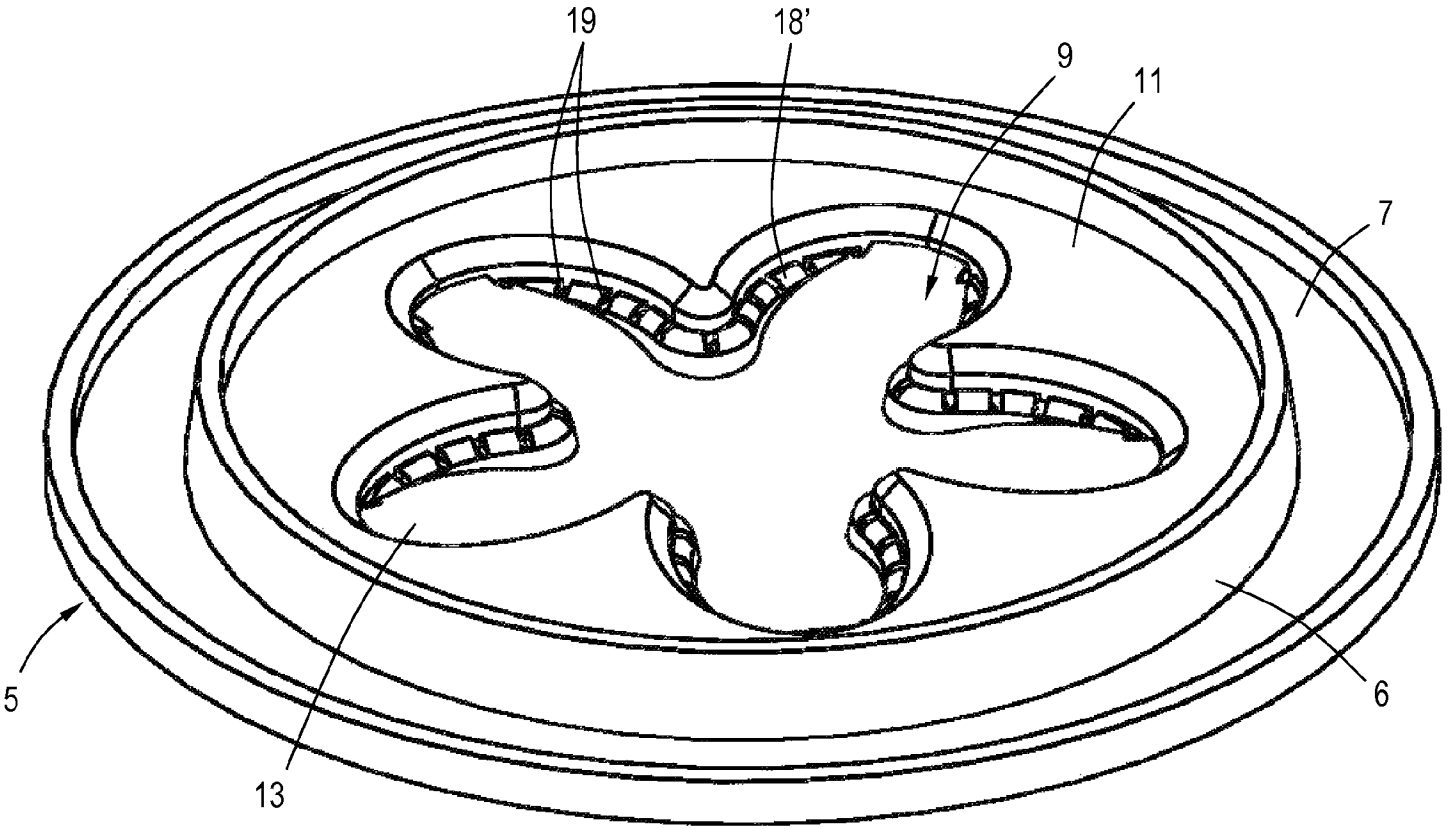
Figure 18D:
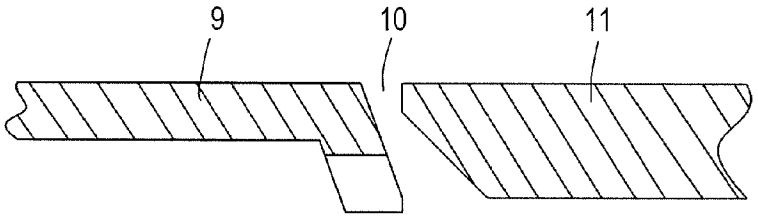
FIGS. 18C-18F are views corresponding to that of FIGS. 17A-17D but showing a different embodiment of the capsule insert.
Figure 18F:
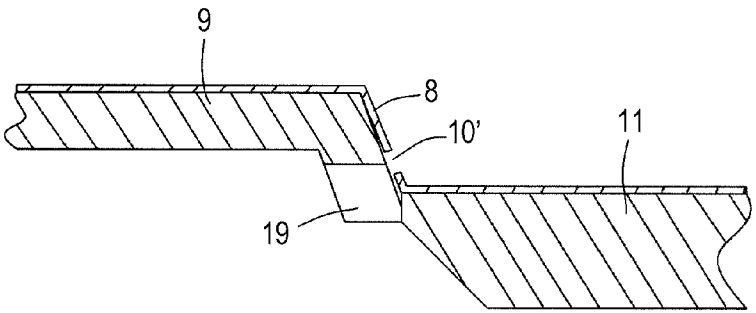
Figure 18C:
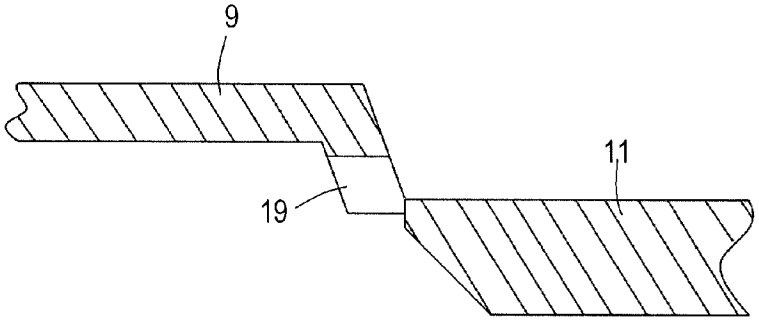
Figure 18E:
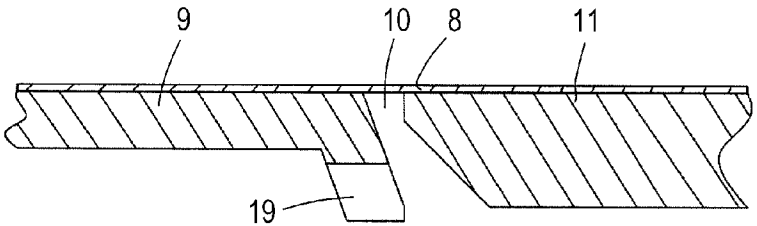

In the embodiment of FIGS. 18A-18F the inlay is also formed with the first portion(s) 9 in a deformed position. However, the first and second portions 9 are not connected to each other over the whole length of the slit to be formed, but through holes or gaps 19 are formed in the material connecting the first and second portions 9, 11, see FIGS. 18A-18C. This material between the first and second portions forms the weakened area 18'. The weakened area is then broken and the first and second portions are brought to the undeformed position in which the outer surfaces of the first and second portions are substantially flush (FIG. 18*d*) and the foil 8 is subsequently attached to these surfaces (FIG. 18E). If the lid 3 is then loaded when the beverage is brewed, the first portion 9 will substantially return to the position in which it was formed (FIG. 18F), so that the openings 10' for the beverage to leave the capsule are formed substantially only by the holes or gaps 19 created during manufacture. Thus, the slit 10, which is present between the first and second portions 9, 11 in the undeformed position of the first portion 9, is partly closed when the first portion 9 is moved by the pressure inside the capsule.

Figures 19A, 19B:
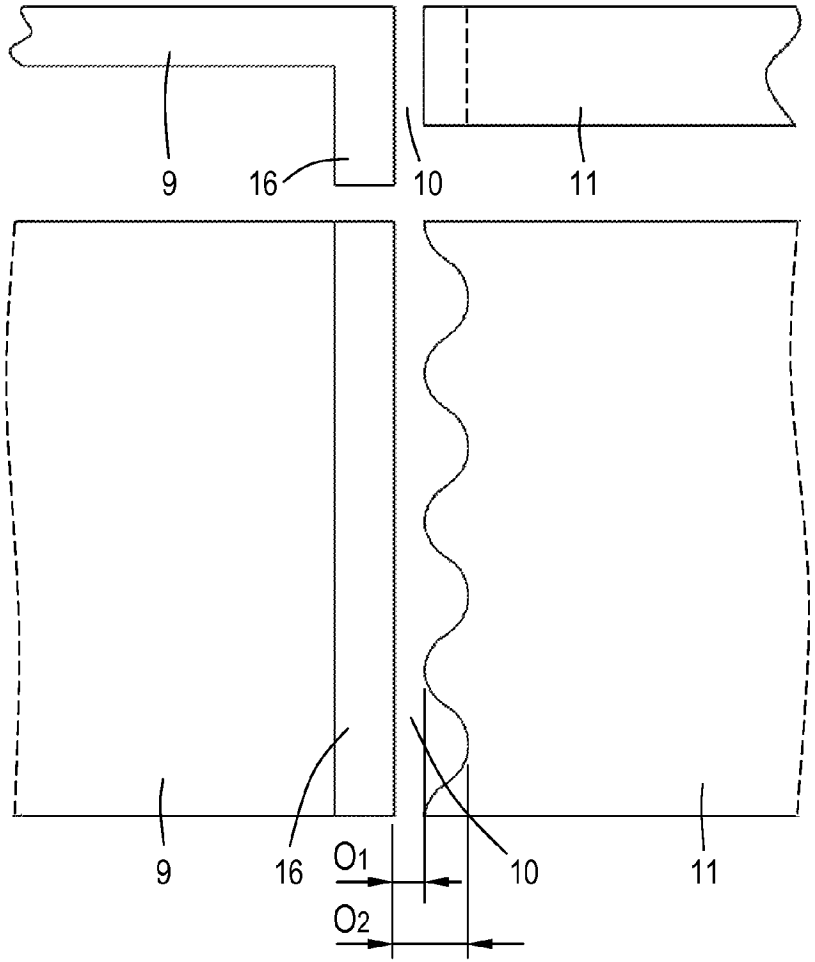
FIGS. 19A, 19B are a plan view and side view, respectively, of a part of a capsule insert according to another embodiment.

FIGS. 19A and 19B show an embodiment of the inlay 5 of the capsule lid 3 wherein one of the edges of the portions 9 and 11 bordering the slit 10 has a sinusoidal shape or other wavy shape so that the mould rib for forming the slit 10 is strengthened by the thickened portions while the widening $O_2$ in the slit approach separate openings of a filter if $O_2$ is small.

In the embodiment of the capsule as shown in FIG. 2, the circumferential wall 1 and bottom 2 (cup) are made from plastic, preferably through thermo forming or injection moulding. The cup can then easily be attached and sealed to the inlay 5 through heat sealing, ultrasonic or laser welding or the like. A mechanical (click) connection would also be feasible between cup and inlay, especially if a seal is used. Such seal could be used both for sealing the cup to the inlay and for sealing the capsule to the coffee machine during its use therein. Such seal could be between the cup and the rib on the inlay and/or between the cup and the rim portion of the inlay 5. If the seal is used for sealing the capsule to the coffee machine, the seal will generally be present on the free rim part 7 of the inlay or on any rim portion 1' of the circumferential wall 1 of the cup. Such combined seal will normally be a resilient seal, such as for example a rubber-elastomeric, plastic-elastomeric, plastic or silicone seal. Instead of from plastic, it would also be possible to make the cup mainly of aluminium material, which could be attached to the inlay in a similar way.

If a seal is used only for sealing the capsule to the coffee machine, such as shown in FIG. 2, a number of other seals can be used, such as a plastically deformable bead especially in the (aluminium) rim portion 1' (not shown), or one or more elastically and/or plastically deformable circumferential ribs on the rim part 7 (not shown). Also other rib shapes could be used.

Figure 20A:
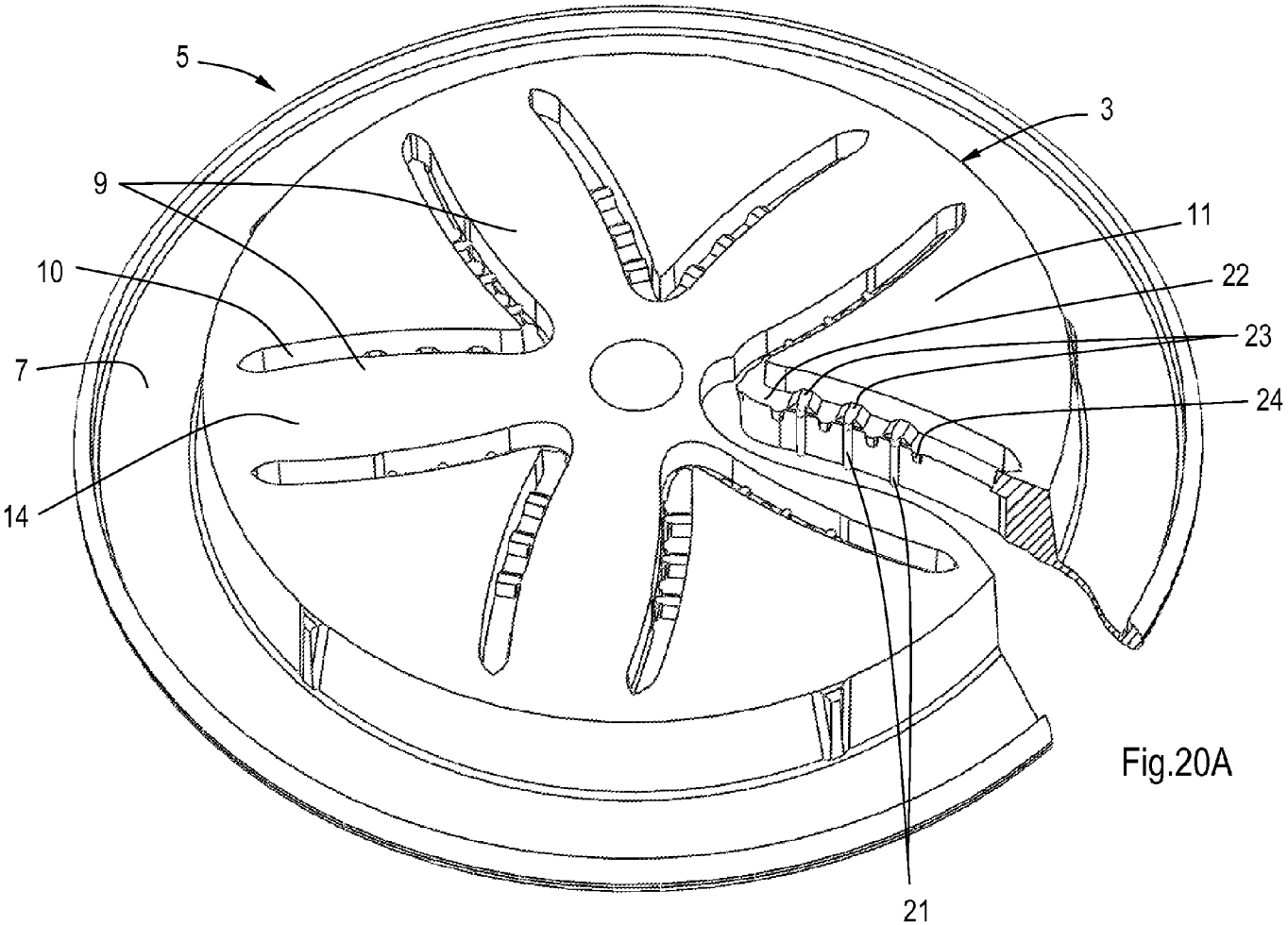
FIG. 20A-20C are perspective views of a capsule insert according to yet another embodiment in closed and opened position (shown without foil) and in opened position (shown with foil).
Figure 20B:
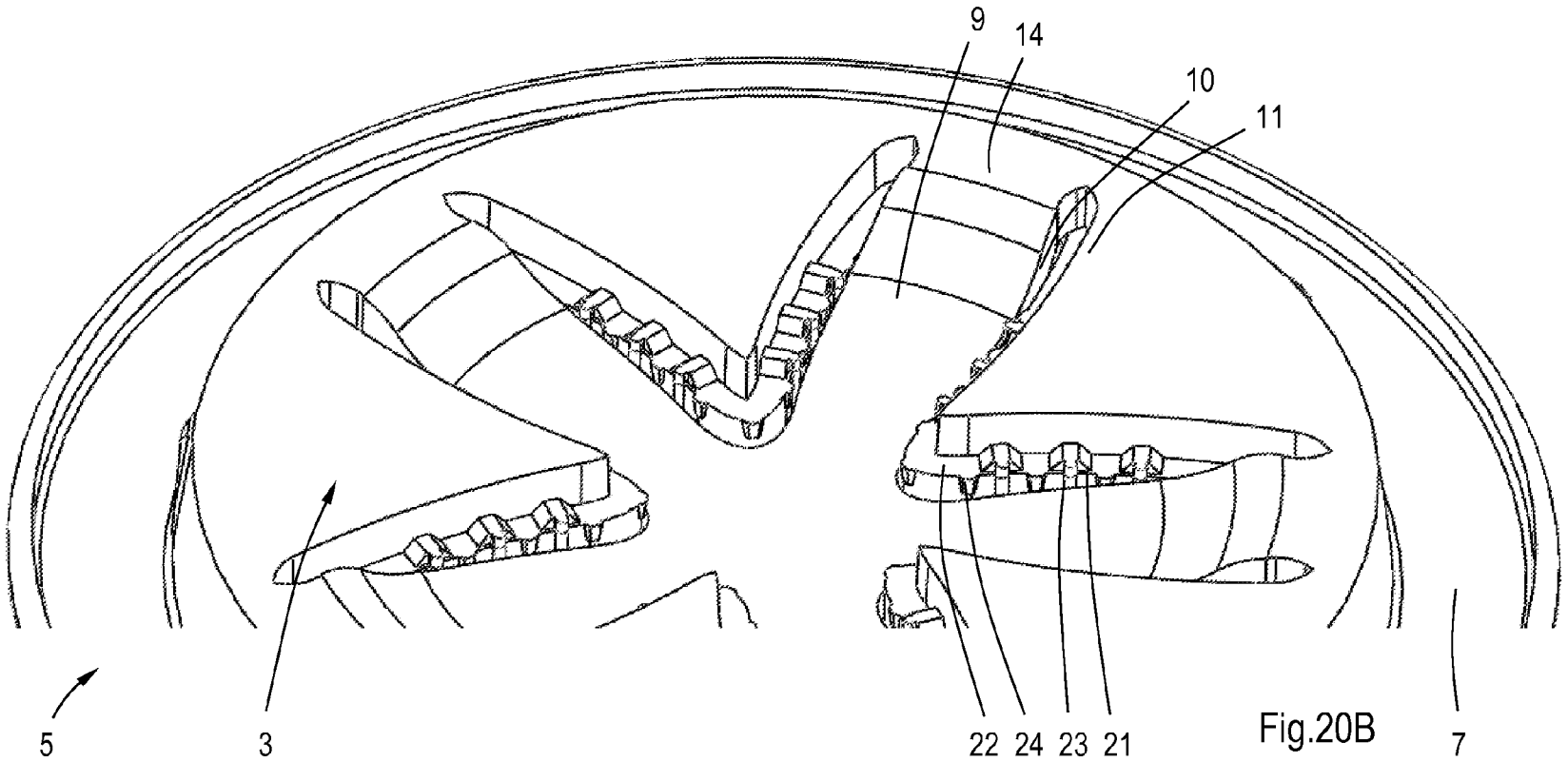
Figure 20C:
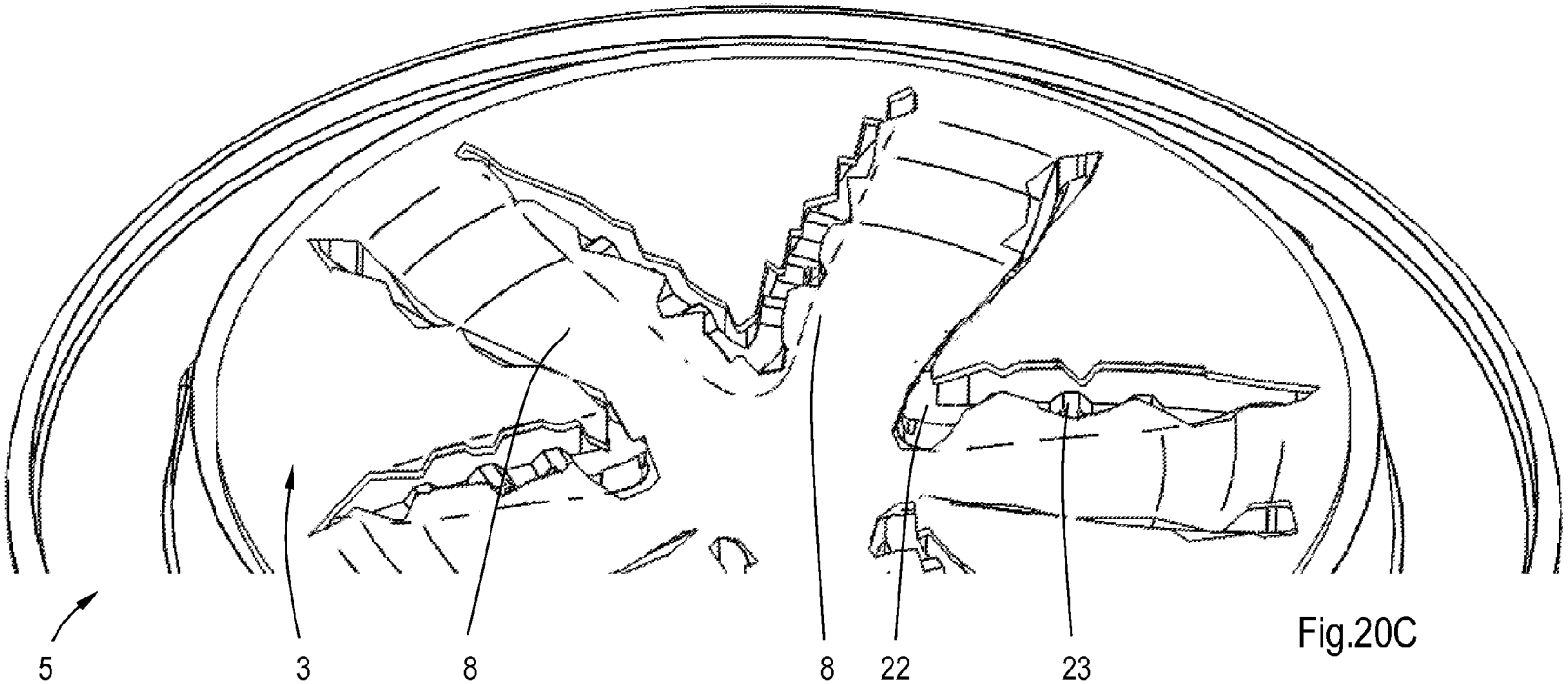

FIGS. 20A-20C show an embodiment in which, like in FIGS. 12A, 12B, 13A and 13B, there is more or less one deformable first portion 9 which has several connections 14 to the second portion 11, in this case five again. The Figures show the inner surface of the lid 3, and in this embodiment the foil 8 is provided on this inner surface (see FIG. 20C because the foil is removed in FIGS. 20A and 20B for illustrative purposes). In this embodiment, the first and second portions are substantially flat on their inner surfaces, and the first portion 9 is pushed outwardly by the inner pressure during use, but will not move to a stable open position. It will move back to the first position when the pressure drops, but of course the capsule will remain open, due to the fact that the foil will be torn then.

The embodiment of FIG. 20 comprises special features within the slits to further improve the operation of the capsule. First of all, the first and or second portion 9, 11 (here the second portion) has on its edge within the slit 10 a plurality of small ribs 21 extending over at least a part of the height of the slit 10. These ribs 21 or other protrusions make sure that during movement of the first portion or first portions 9 the width of the slit dimensions remains relatively even along the length of the slit 10, thus enhancing the functionality of a filter, i.e. letting the liquid (e.g. coffee) go through while preventing other contents (e.g. ground coffee) from exiting the capsule. These ribs 21 prevent lateral movement of the first portions 9 to a large extent, as they extend across a large part of the width of the slit 10.

FIGS. 20A-20C further show that the inner surface of the second portion 11 is deepened adjacent the slits 10, and in these deepened ridges 22 there are created formations 23, here at the position of the ribs 21. These formations 23 can have different shapes, here they are roof shaped, while the ribs 21 start from the top of the roof of these formations 23. Small noses 24 may be formed between the ribs 21 and formations 23 and extend into the slit 10 as well, but will not extend the complete (local) height of the slit 10. These formations 23 and noses 24 will promote formation of dome shapes in the particle bed adjacent to the slits, which prevents collapse of the particle bed and thereby prevents particles in the particle bed from being pushed through the slits 10.

FIGS. 20B and 20C show the lid 3 when under pressure, and FIG. 20C shows how the foil 8 may be torn and will be pushed with its edges onto the ridges 22. The cooperation between the foil 8 and the formations 23 might act as a filter on the one hand and will further promote formation of dome shapes in the particle bed adjacent to the slits.

Figure 21:
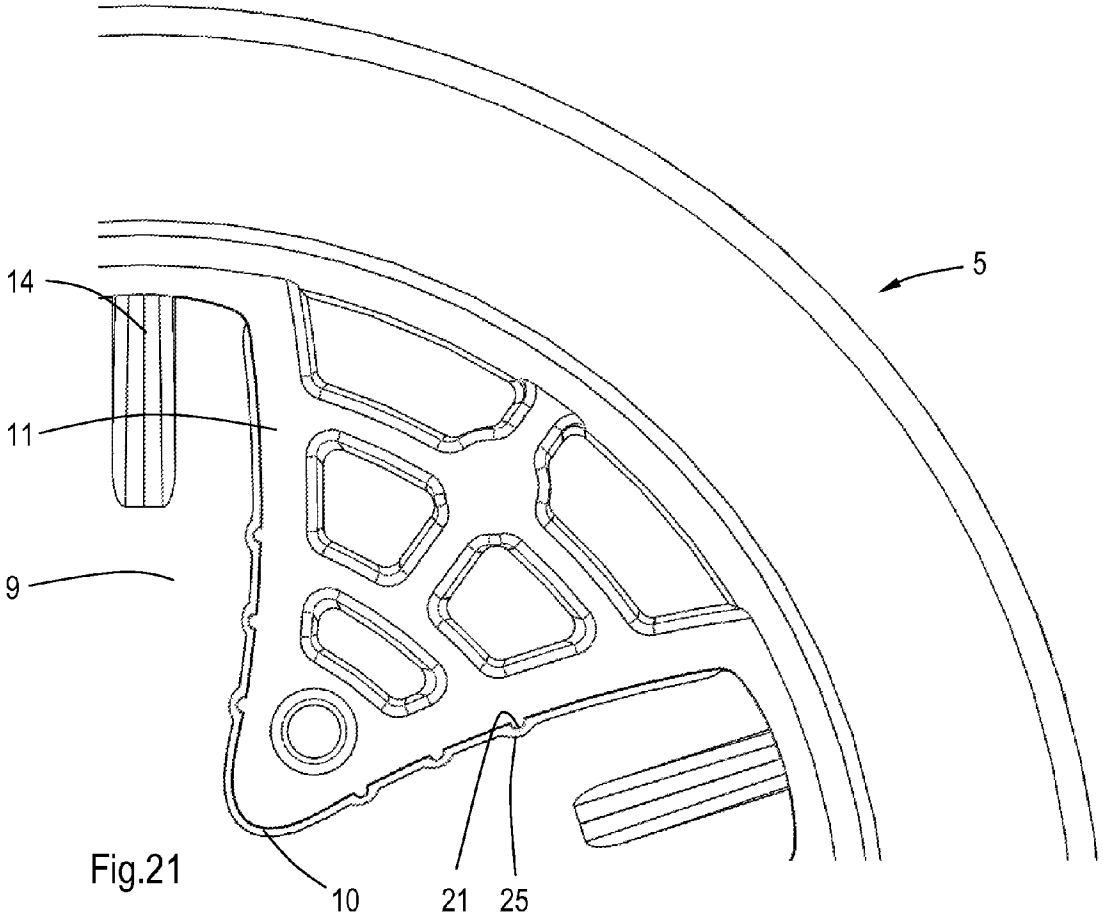
FIG. 21 is an enlarged bottom view of still another embodiment of the lid of a capsule insert.

FIG. 21 shows again ribs 21 within the slits, but now with fitting recesses 25 in the opposite wall of the slit, i.e. in the first portions 9 in order to create meandering slits 10 which also promotes the creation of domes in the particle bed preventing collapse of the particle bed and escape of particles from the bed. FIG. 21 also shows how the second part 11 is stiffened by internal rib formations.

Figure 22C:
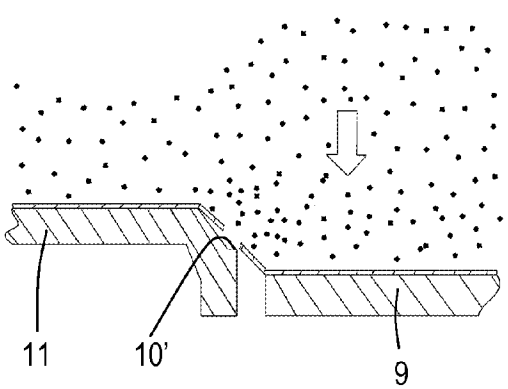
FIGS. 22A-22C and 23A-23C are views corresponding to that of FIG. 5A-5C but showing further embodiments.
Figure 22B:
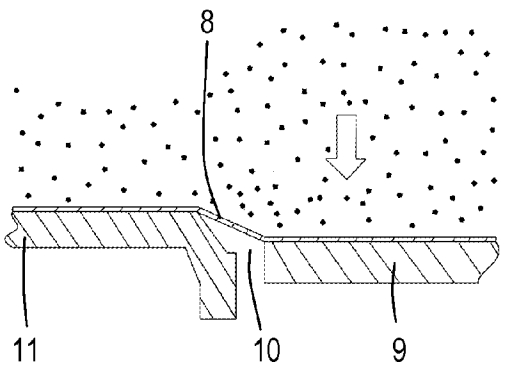
Figure 22A:
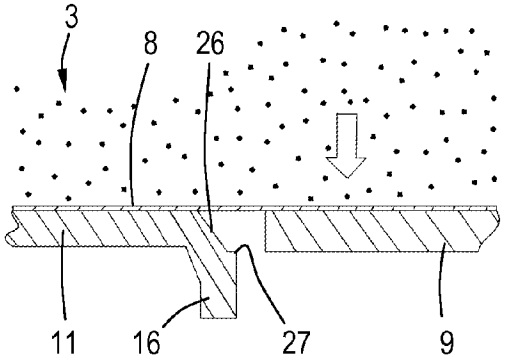

FIG. 22A-22C show a further variation of FIG. 15 wherein a side wall 26 of the second portion 11 is inclined and has a sharp edge 27 to promote tearing of the foil 8 at that position.

Figure 23C:
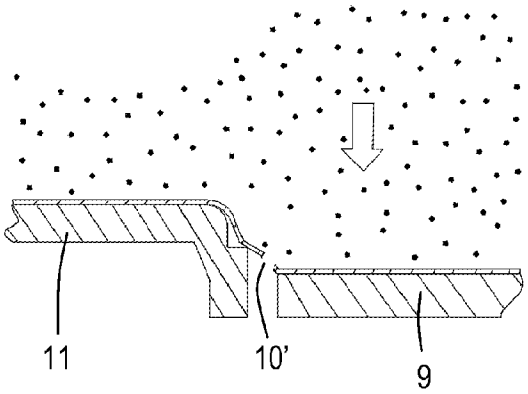
Figure 23B:
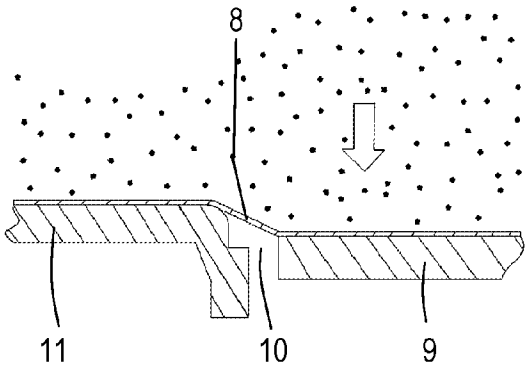
Figure 23A:
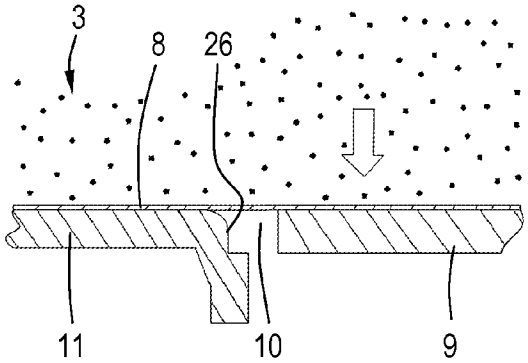

FIG. 23A-23C show another variation of FIG. 22 wherein the side wall 26 of the second portion is not inclined but is rounded adjacent the inner surface of the lid 3, in order to prevent the foil 8 from tearing at that position, but has a sharp edge 27 deeper towards the slit to promote tearing of the foil 8 there. This sharp edge 27 may be the edge of the ridge 22 and may be provided with the formations 23 and noses 24 which also might promote the tearing of the foil 8 there to create the opening 10'.

Figure 24:
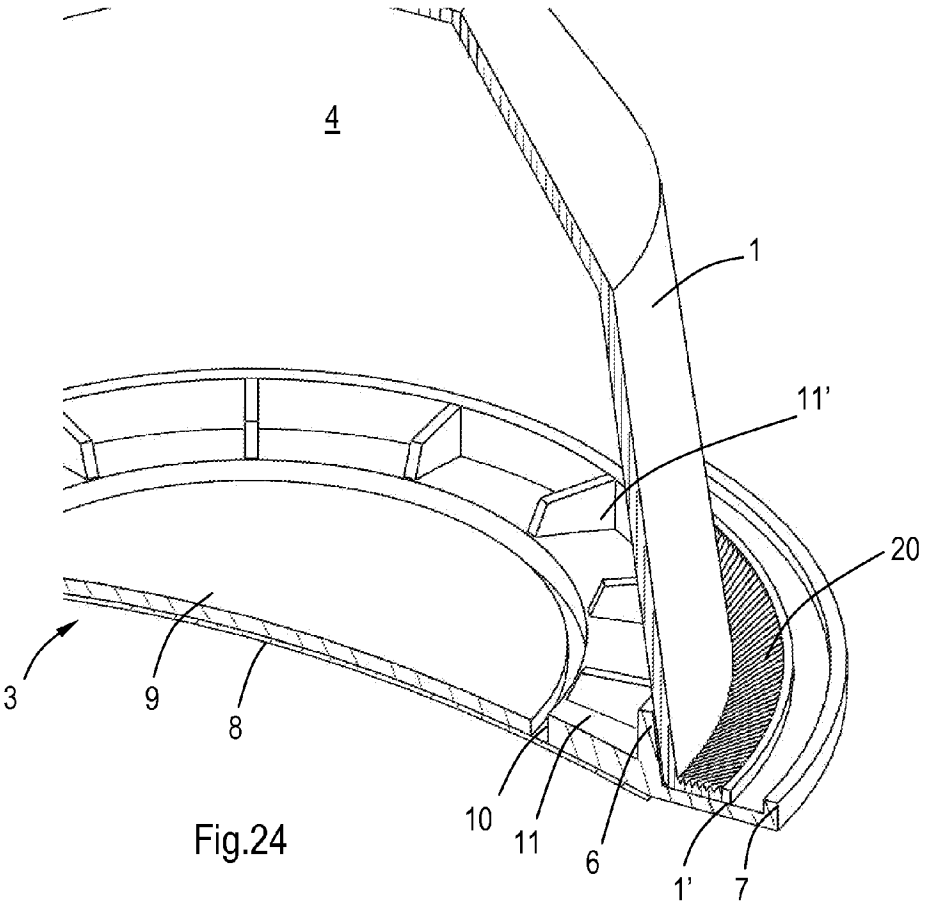
FIG. 24 is a very schematic plan view of the capsule side wall and connecting sealing ribs formed on the inlay (not shown).

FIG. 24 shows an embodiment of a capsule having sealing ribs 20, here formed on the rim portion 1' of the side wall 1 of the capsule. They could also be formed on the rim part 7 of the inlay 5. The ribs 20 are formed from the same or different material as the side wall or the rim 7. These ribs 20 are fan-shaped and extend from the side wall 1 of the capsule towards the outer edge of the rim part 7, here up to an upwardly protruding circumferential edge of the rim portion 1' which is slightly higher than the ribs 20. The ribs as shown have a triangular cross-sectional shape. Other cross-sectional and longitudinal shapes of the ribs 20 are conceivable as well.

Further it is conceivable to use a swellable seal fixed to the rim portion 1' of the cup or rim part 7 of the inlay 5. The swelling or volume increase could be caused by the presence of water or by a rise in temperature. The swellable seal could be made from super absorbent polymers (SAP), i.e. cross-linked hydrogels, for example in the form of non-wovens, natural fibers, such as paper or cardboard, or materials having a large thermal coefficient of expansion. The seal could be made as a laminate, for example including an adhesive layer, an absorbing layer and a water transmitting anti adhesive top coating. If the seal includes plastic, it could be heat sealed as well.

Embodiments of the inventions are disclosed below:

Embodiment 1

Capsule for the preparation of a beverage using an extractable and/or dissolvable product and a quantity of hot and/or pressurized liquid, comprising:

a circumferential wall having on one end a bottom adapted to allow entrance of the liquid, and on an opposite end a lid closing said end of the circumferential wall, the circumferential wall, bottom and lid enclosing an inner space containing the product, the lid comprising at least one first portion and at least one second portion separated by at least one slit and having different moving mechanics when under pressure so that the first and second portions will then move relatively at least at the position of the slit, and comprising at least a layer of tearable material covering said slit and thereby fully closing the inner space.

Embodiment 2

Capsule according to embodiment 1, wherein the rigidity of the first and second portions is substantially greater than that of the layer of tearable material.

Embodiment 3

Capsule according to embodiment 1 or 2, wherein the moving mechanics of the first and second portions is such that the at least one first portion at least partly moves outwardly with respect to the at least one second portion which may remain substantially stationary when under pressure.

Embodiment 4

Capsule according to any one of the preceding embodiments, wherein the at least first and second portions of the lid are partly connected to each other by at least one connection locally bridging the at least one slit.

Embodiment 5

Capsule according to embodiment 4, wherein the first and second portions are interconnected by a plurality of spaced connections determining the relative movement of the first and second portions.

Embodiment 6

Capsule according to embodiment 4 or 5, wherein the at least one connection between the first and second portions is such that the relative movement between the first and second portion allowed by the at least one connection is maximized in one position and minimized in another position.

Embodiment 7

Capsule according to embodiment 6, wherein at least a part of the connections act as a stop limiting the relative movement of the first and second parts.

Embodiment 8

Capsule according to any one of embodiments 4-7, wherein at least a part of the connections act as a plastically and/or elastically deformable hinge.

Embodiment 9

Capsule according to any one of the preceding embodiments, comprising a plurality of first portions moving independently.

Embodiment 10

Capsule according to any one of embodiments 1-8, comprising a plurality of interconnected first portions each having at least a connection to the at least one second portion.

Embodiment 11

Capsule according to any of the embodiments 1-8, comprising one first deformable portion comprising a plurality of connections to the second portion which are spaced around the first portion.

Embodiment 12

Capsule according to any one of the preceding embodiments, wherein the at least one slit is serpentine shaped so as to enlarge its length and be distributed across the area of the lid.

Embodiment 13

Capsule according to any one of the preceding embodiments, wherein the at least one second portion is positioned adjacent to the circumferential wall.

Embodiment 14

Capsule according to any one of the preceding embodiments, wherein the first and/or second portion are provided with at least a pointed area bordering the slit and adjacent to the tearable material.

Embodiment 15

Capsule according to embodiments 8 and 14, wherein the pointed area is positioned at a distance from the hinge, and particularly where the first and second portion obtain a maximum relative movement when under pressure.

Embodiment 16

Capsule according to any one of the preceding embodiments, wherein the first and second portions of the lid are made mainly of plastic material.

Embodiment 17

Capsule according to any one of the preceding embodiments, wherein the layer of tearable material is made from a foil, in particular from a non-plastic material or a laminate of plastic and non-plastic material, permanently attached to at least a part of the inner or outer surface of the first and second portions.

Embodiment 18

Capsule according to embodiment 17, wherein the layer of tearable material is made mainly from a metal, in particular aluminium foil attached to the first and second portions and preferably covering at least a substantial part of the lid.

Embodiment 19

Capsule according to any one of the preceding embodiments, wherein the first or second portions are provided with stiffening members, such as stiffening ribs.

Embodiment 20

Capsule according to embodiment 19, wherein the stiffening members are provided on the inside or outside of the lid.

Embodiment 21

Capsule according to any one of the preceding embodiments, wherein at least the at least one first portion of the lid is concavely shaped.

Embodiment 22

Capsule according to embodiment 21, wherein at least the at least one first portion of the lid is adapted to be moved from a concave to a, preferably stable, convex shape when under pressure from the inner space of the capsule.

Embodiment 23

Capsule according to any one of the preceding embodiments, wherein the surface area of the at least one first portion is more than 30%, preferably more than 50%, and more preferably more than 70% of the total area of the lid defining the inner space.

Embodiment 24

Capsule according to any one of the preceding embodiments, wherein the lid is provided with an exit filter at least at the position of the slit to keep non-liquids within the inner space.

Embodiment 25

Capsule according to any one of the preceding embodiments, wherein the relative movement between the first and second portions relative to the thickness of the first and second portions at the position of the at least one slit is so small that the first and second portions remain overlapping in their direction of movement in the opened position of the lid during use.

Embodiment 26

Capsule according to embodiment 25, wherein the thickness of at least one of the first and second portions is increased adjacent to the slits, for example by a rib formed along the circumference of the inner surface of the first portion and/or the outer surface of the second portion(s), and wherein preferably at least one of the first and second portions includes a plurality of local protrusions distributed over the length of the at least one slit and protruding towards the other of the first and second portions, and preferably extending the thickness of the first or second portion.

Embodiment 27

Capsule according to any one of the preceding embodiments, wherein the lid is part of a separate element that is attached to the circumferential wall, for example by at least one of the group of welding, heat sealing, gluing and mechanically connecting.

Embodiment 28

Capsule according to embodiment 27, wherein the separate element includes a circumferential rim part connecting to the circumferential wall and extending outwardly beyond it at an angle thereto.

Embodiment 29

Capsule according to embodiment 28, wherein the rim part is provided with a ring-shaped seal in its side facing the bottom of the capsule.

Embodiment 30

Capsule according to any one of the preceding embodiments, wherein the circumferential wall and bottom are made of plastic material.

Embodiment 31

Capsule according to any one of embodiments 1-29, wherein the circumferential wall and bottom are made of mainly aluminium.

Embodiment 32

Capsule for the preparation of a beverage using an extractable or dissolvable product and a quantity of hot and/or pressurized liquid, comprising:

a circumferential wall having on one end a bottom adapted to allow entrance of the liquid, and on an opposite end a lid closing said end of the circumferential wall, the circumferential wall, bottom and lid enclosing an inner space containing the extractable or dissolvable product, the lid being made at least partly of plastic and being part of a separate element attached to the circumferential wall.

Embodiment 33

Capsule according to embodiment 32, wherein the separate element is provided with a circumferential rib fitting into the inner space and being adapted to the shape of the circumferential wall.

Embodiment 34

Capsule according to embodiment 32 or 33, wherein the separate element is provided with a rim part extending beyond the circumferential wall and at an angle thereto.

Embodiment 35

Capsule according to embodiment 34, wherein the circumferential wall is provided with a rim portion fitting onto the rim part of the separate element, the separate element being fixed and sealed to the circumferential wall at least at the position of the rim part.

Embodiment 36

Capsule according to embodiment 34 or 35, wherein the rim is provided with a ring-shaped seal in its side facing the bottom of the capsule.

Embodiment 37

Method of producing a capsule for the preparation of a beverage using an extractable or dissolvable product and a quantity of hot and/or pressurized liquid, comprising a circumferential wall having on one end a bottom, and on an opposite end a lid closing said end of the circumferential wall, the lid being made at least partly of plastic and being part of a separate element attached to the circumferential wall, as well as an external seal to seal the capsule with respect to a brewing chamber, the method including the steps of making the circumferential wall and bottom, the lid and the seal, bringing these elements together and interconnecting them, preferably in one step.

Embodiment 38

Method of producing a capsule for the preparation of a beverage using an extractable or dissolvable product and a quantity of hot and/or pressurized liquid, comprising a circumferential wall having on one end a bottom, and on an opposite end a lid closing said end of the circumferential wall, the lid being made with first and second portions separated by a weakened portion, the weakened portion being broken during manufacture so that the first and second portions are separated substantially by a broken line forming a slit, this slit being then covered by a tearable material.

Embodiment 39

Method of producing a capsule for the preparation of a beverage using an extractable or dissolvable product and a quantity of hot and/or pressurized liquid, comprising a circumferential wall having on one end a bottom, and on an opposite end a lid closing said end of the circumferential wall, the lid being made with first and second portions separated by a slit which is covered by tearable material, the first and second portions are relatively movable between a first position in which the slit is covered by the tearable material and a second position in which the tearable material is torn and an opening between the first and second portion is created for the beverage to exit the capsule, wherein the first and second portions of the lid are formed by injection moulding plastic material and with the first and second portions in their second position.

Embodiment 40

Method according to embodiments 38 and 39, wherein the weakened portion between the first and second portions when in their second positions during manufacture is formed with holes forming the openings for the beverage to exit the capsule when the tearable material is torn. From the foregoing it will be clear that the invention provides a (method of producing a) capsule for making a beverage, which is opened during use in a reliable and predictable manner.

The invention is not limited to the embodiments shown which can be varied in different manners. Features of the different embodiments shown or described could be used in other combinations. The lid may also be integrated with the circumferential wall, especially if the bottom is formed as a separate element. The tearable material may comprise not a foil but another material covering or provided in the slit. It is also not necessary that it is torn completely, only in places where beverage should leave the capsule. The material could also tear in another way.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A capsule for the preparation of a beverage using an extractable and/or dissolvable product and a quantity of hot and/or pressurized liquid, comprising: a circumferential wall having on one end a bottom configured to allow entrance of the liquid, and on an opposite end a lid closing said end of the circumferential wall and configured to allow exit of the beverage, the circumferential wall, bottom and lid enclosing an inner space containing the product, at least one of the lid and bottom comprising at least one first portion and at least one second portion separated by at least one slit and having different moving mechanics when under pressure so that the first and second portions of the at least one of the lid and bottom will then move relatively at least at the position of the at least one slit, and comprising at least a layer of tearable material, made from a foil, permanently attached to at least a part of an inner or outer surface of the first and second portions, covering said slit and thereby fully closing the inner space, said at least a layer of tearable foil material being configured to be torn by the first and second portions moving relatively at the position of the at least one slit when under pressure.

2. The capsule according to claim 1, wherein the rigidity of the first and second portions is substantially greater than that of the layer of tearable material.

3. The capsule according to claim 1, wherein the first and second portions are configured such that the at least one first portion at least partly moves outwardly with respect to the at least one second portion which may remain substantially stationary when under pressure.

4. The capsule according to claim 1, wherein the at least first and second portions are partly connected to each other by at least one connection locally bridging the at least one slit.

5. The capsule according to claim 4, wherein the first and second portions are interconnected by a plurality of connections determining the relative movement of the first and second portions.

6. The capsule according to claim 4, wherein at least a part of the connections act as a plastically and/or elastically deformable hinge.

7. The capsule according to claim 1, wherein the at least one first portion comprises a plurality of first portions configured to move independently.

8. The capsule according to claim 1, wherein the at least one first portion comprises a plurality of interconnected first portions each having at least a connection to the at least one second portion.

9. The capsule according to claim 1, wherein the at least one first portion comprises one deformable first portion comprising a plurality of connections to the second portion which are spaced and distributed around the deformable first portion.

10. The capsule according to claim 1, wherein the at least one slit is serpentine shaped so as to enlarge its length and be distributed across the area of the lid or bottom.

11. The capsule according to claim 1, wherein the first and/or second portion are provided with at least a pointed area.

12. The capsule according to claim 1, wherein the first and second portions are made mainly of plastic material.

13. The capsule according to claim 1, wherein the at least a layer of tearable material, made from the foil, is part of a laminate also including a layer of tearable plastic material.

14. The capsule according to claim 13, wherein the thickness of at least one of the first and second portions is increased adjacent to the slits, by a rib formed along the circumference of the inner surface of the first portion and/or the outer surface of the second portion(s), and wherein at least one of the first and second portions includes a plurality of local protrusions distributed over the length of the at least one slit and protruding towards the other of the first and second portions, and extending the thickness of the first or second portion.

15. The capsule according to claim 1, wherein the relative movement between the first and second portions relative to the thickness of the first and second portions at the position of the at least one slit is so small that the first and second portions remain overlapping in their direction of movement in the opened position of the lid and/or bottom during use.

16. The capsule according to claim 1, wherein the lid and/or bottom is part of a separate element that is attached to the circumferential wall by welding.

17. The capsule according to claim 1, wherein the lid and/or bottom is part of a separate element that is attached to the circumferential wall by heat sealing.

18. The capsule according to claim 1, wherein the lid and/or bottom is part of a separate element that is attached to the circumferential wall by gluing.

19. The capsule according to claim 1, wherein the lid and/or bottom is part of a separate element that is attached to the circumferential wall by mechanically connecting.

* * * * *